US008247358B2

(12) United States Patent
Lee et al.

(10) Patent No.: US 8,247,358 B2
(45) Date of Patent: Aug. 21, 2012

(54) HVI-PAO BI-MODAL LUBRICANT COMPOSITIONS

(75) Inventors: Gordon H. Lee, Newtown, PA (US); Kevin A. Chinn, Mount Laurel, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 224 days.

(21) Appl. No.: 12/587,039

(22) Filed: Oct. 1, 2009

(65) Prior Publication Data

US 2010/0087349 A1 Apr. 8, 2010

Related U.S. Application Data

(60) Provisional application No. 61/195,153, filed on Oct. 3, 2008.

(51) Int. Cl.
*C10M 111/04* (2006.01)
*C10G 71/00* (2006.01)

(52) U.S. Cl. ..... 508/499; 208/19

(58) Field of Classification Search ..... 508/499; 208/19

See application file for complete search history.

(56) References Cited

U.S. PATENT DOCUMENTS

| | | | |
|---|---|---|---|
| 2,978,442 | A | 4/1961 | Brightbill et al. |
| 3,149,178 | A | 9/1964 | Hamilton et al. |
| 3,164,578 | A | 1/1965 | Baker et al. |
| 3,382,291 | A | 5/1968 | Brennan |
| 3,576,923 | A | 4/1971 | Randell et al. |
| 3,742,082 | A | 6/1973 | Brennan |
| 3,769,363 | A | 10/1973 | Brennan |
| 3,780,128 | A | 12/1973 | Shubkin |
| 3,876,720 | A | 4/1975 | Heilman et al. |
| 3,883,417 | A | 5/1975 | Woo et al. |
| 4,016,349 | A | 4/1977 | McKenna |

(Continued)

FOREIGN PATENT DOCUMENTS

EP 0119069 A2 9/1984

(Continued)

OTHER PUBLICATIONS

D. A. Law, J. R. Lohuis, J. Y. Breau, A. J. Harlow, M. Rochette; "Development and Performance Advantages of Industrial, Automotive and Aviation Synthetic Lubricants," Journal of Synthetic Lubrication (1), pp. 6-33.

(Continued)

*Primary Examiner* — Walter D Griffin
*Assistant Examiner* — Francis C Campanell
(74) *Attorney, Agent, or Firm* — Robert A. Migliorini

(57) ABSTRACT

The invention relates to oil compositions containing metallocene catalyzed high viscosity index polyalphaolefins (HVI-PAO). In one embodiment the oil formulation comprises a metallocene catalyzed HVI-PAO with a viscosity greater than 125 cSt kv 100° C. and a viscosity index greater than 100, a second base stock with a viscosity of at least 2 cSt kv 100° C. and less than 60 cSt kv 100° C. wherein the second base stock is at least 60 cSt kv 100° C. less than the metallocene HVI-PAO, an ester with a viscosity of at least 2 and less than 6, the ester comprising more than 10 weight percent and less than 30 weight percent of the oil formulation, the oil formulation having a viscosity index of greater than 195. The use of metallocene catalyzed HVI-PAOs in a bimodal blend provides advantages in improved shear stability, and other properties related to shear stability.

14 Claims, 5 Drawing Sheets

U.S. PATENT DOCUMENTS

| | | | |
|---|---|---|---|
| 4,132,663 | A | 1/1979 | Heilman et al. |
| 4,172,855 | A | 10/1979 | Shubkin et al. |
| 4,180,575 | A | 12/1979 | Rochling et al. |
| 4,234,435 | A | 11/1980 | Meinhardt et al. |
| 4,239,930 | A | 12/1980 | Allphin et al. |
| 4,263,150 | A | 4/1981 | Clason et al. |
| 4,263,465 | A | 4/1981 | Sheng et al. |
| 4,289,635 | A | 9/1981 | Schroeck |
| 4,308,154 | A | 12/1981 | Clason et al. |
| 4,367,352 | A | 1/1983 | Watts, Jr. et al. |
| 4,413,156 | A | 11/1983 | Watts, Jr. et al. |
| 4,417,990 | A | 11/1983 | Clason et al. |
| 4,434,308 | A | 2/1984 | Larkin et al. |
| 4,451,684 | A | 5/1984 | Pasky |
| 4,469,912 | A | 9/1984 | Blewett et al. |
| 4,511,481 | A | 4/1985 | Shim |
| 4,587,368 | A | 5/1986 | Pratt |
| 4,594,378 | A | 6/1986 | Tipton et al. |
| 4,604,491 | A | 8/1986 | Dressler et al. |
| 4,652,416 | A | 3/1987 | Millot |
| 4,658,072 | A | 4/1987 | Johnson |
| 4,701,273 | A | 10/1987 | Brady et al. |
| 4,701,489 | A | 10/1987 | Hughes et al. |
| 4,704,491 | A | 11/1987 | Tsutsui et al. |
| 4,734,209 | A | 3/1988 | Phillips et al. |
| 4,776,967 | A | 10/1988 | Ichihashi et al. |
| 4,827,064 | A | 5/1989 | Wu |
| 4,827,073 | A | 5/1989 | Wu |
| 4,867,890 | A | 9/1989 | Colclough et al. |
| 4,892,851 | A | 1/1990 | Ewen et al. |
| 4,906,799 | A | 3/1990 | Forbus, Jr. et al. |
| 4,910,355 | A | 3/1990 | Shubkin et al. |
| 4,912,272 | A | 3/1990 | Wu |
| 4,914,254 | A | 4/1990 | Pelrine |
| 4,922,046 | A | 5/1990 | Kinoshita et al. |
| 4,926,004 | A | 5/1990 | Pelrine et al. |
| 4,943,383 | A | 7/1990 | Avery et al. |
| 4,950,822 | A | 8/1990 | Dileo et al. |
| 4,956,122 | A | 9/1990 | Watts et al. |
| 4,962,249 | A | 10/1990 | Chen et al. |
| 4,962,262 | A | 10/1990 | Winter et al. |
| 4,967,032 | A | 10/1990 | Ho et al. |
| 4,990,709 | A | 2/1991 | Wu |
| 4,990,711 | A | 2/1991 | Chen et al. |
| 4,990,771 | A | 2/1991 | Minoura et al. |
| 5,012,020 | A | 4/1991 | Jackson et al. |
| 5,017,299 | A | 5/1991 | Gutierrez et al. |
| 5,017,714 | A | 5/1991 | Welborn, Jr. |
| 5,057,235 | A | 10/1991 | Farng et al. |
| 5,068,487 | A | 11/1991 | Theriot |
| 5,087,788 | A | 2/1992 | Wu |
| 5,104,579 | A | 4/1992 | Benjamin et al. |
| 5,105,038 | A | 4/1992 | Chen et al. |
| 5,113,030 | A | 5/1992 | Chen et al. |
| 5,132,478 | A | 7/1992 | Ho et al. |
| 5,146,021 | A | 9/1992 | Jackson et al. |
| 5,157,177 | A | 10/1992 | Pelrine et al. |
| 5,171,195 | A | 12/1992 | Funamoto |
| 5,177,276 | A | 1/1993 | Beach et al. |
| 5,180,865 | A | 1/1993 | Heilman et al. |
| 5,186,851 | A | 2/1993 | Gutierrez et al. |
| 5,187,236 | A | 2/1993 | Coolbaugh et al. |
| 5,187,250 | A | 2/1993 | Asanuma et al. |
| 5,188,724 | A | 2/1993 | Heilman et al. |
| 5,188,746 | A | 2/1993 | Davis |
| 5,190,682 | A | 3/1993 | Harris |
| 5,208,403 | A | 5/1993 | Buchanan et al. |
| 5,220,100 | A | 6/1993 | Massie et al. |
| 5,243,114 | A | 9/1993 | Johnson et al. |
| 5,254,274 | A | 10/1993 | Ho et al. |
| 5,264,642 | A | 11/1993 | Wu |
| 5,268,427 | A | 12/1993 | Coolbaugh et al. |
| 5,275,749 | A | 1/1994 | Kugel et al. |
| 5,276,100 | A | 1/1994 | Coolbaugh et al. |
| 5,276,227 | A | 1/1994 | Wu et al. |
| 5,276,277 | A | 1/1994 | Hightower et al. |
| 5,292,820 | A | 3/1994 | Coolbaugh et al. |
| 5,315,053 | A | 5/1994 | Beach et al. |
| 5,344,578 | A | 9/1994 | Wei et al. |
| 5,352,743 | A | 10/1994 | Coolbaugh et al. |
| 5,358,628 | A | 10/1994 | Apelian et al. |
| 5,359,009 | A | 10/1994 | Coolbaugh et al. |
| 5,369,196 | A | 11/1994 | Matsumoto et al. |
| 5,371,248 | A | 12/1994 | Rudnick |
| 5,376,722 | A | 12/1994 | Coolbaugh et al. |
| 5,382,739 | A | 1/1995 | Atkins et al. |
| 5,395,538 | A | 3/1995 | Rudnick et al. |
| 5,399,629 | A | 3/1995 | Coolbaugh et al. |
| 5,436,379 | A | 7/1995 | Heilman et al. |
| 5,462,995 | A | 10/1995 | Hosaka et al. |
| 5,498,815 | A | 3/1996 | Schaerfl, Jr. et al. |
| 5,552,071 | A | 9/1996 | Rudnick et al. |
| 5,602,086 | A | 2/1997 | Le et al. |
| 5,643,440 | A | 7/1997 | Borghard et al. |
| 5,679,812 | A | 10/1997 | Winter et al. |
| 5,688,887 | A | 11/1997 | Bagheri et al. |
| 5,705,577 | A | 1/1998 | Rossi et al. |
| 5,731,254 | A | 3/1998 | Winter et al. |
| 5,807,949 | A | 9/1998 | Rossi et al. |
| 5,811,379 | A | 9/1998 | Rossi et al. |
| 5,817,605 | A | 10/1998 | Papay |
| 5,846,896 | A | 12/1998 | Ewen |
| 5,852,143 | A | 12/1998 | Sishta et al. |
| 5,858,935 | A | 1/1999 | Watts et al. |
| 5,859,159 | A | 1/1999 | Rossi et al. |
| 5,885,438 | A | 3/1999 | Apelian et al. |
| 6,043,401 | A | 3/2000 | Bagheri et al. |
| 6,080,301 | A | 6/2000 | Berlowitz et al. |
| 6,087,307 | A | 7/2000 | Kaminski et al. |
| 6,090,989 | A | 7/2000 | Trewella et al. |
| 6,133,209 | A | 10/2000 | Rath et al. |
| 6,147,271 | A | 11/2000 | Strebel et al. |
| 6,165,949 | A | 12/2000 | Berlowitz et al. |
| 6,180,575 | B1 | 1/2001 | Nipe |
| 6,184,186 | B1 | 2/2001 | Ryan et al. |
| 6,332,974 | B1 | 12/2001 | Wittenbrink et al. |
| 6,388,032 | B1 | 5/2002 | Yamaura et al. |
| 6,395,948 | B1 | 5/2002 | Hope et al. |
| 6,414,090 | B2 | 7/2002 | Minami et al. |
| 6,429,345 | B1 | 8/2002 | Joly et al. |
| 6,479,722 | B1 | 11/2002 | De Wet et al. |
| 6,548,723 | B2 | 4/2003 | Bagheri et al. |
| 6,548,724 | B2 | 4/2003 | Bagheri et al. |
| 6,589,920 | B2 | 7/2003 | Okada et al. |
| 6,642,169 | B2 | 11/2003 | Weatherhead |
| 6,646,174 | B2 | 11/2003 | Clarembeau |
| 6,706,828 | B2 | 3/2004 | DiMaio |
| 6,713,438 | B1 * | 3/2004 | Baillargeon et al. ..... 508/463 |
| 6,824,671 | B2 | 11/2004 | Goze et al. |
| 6,858,767 | B1 | 2/2005 | DiMaio et al. |
| 6,869,917 | B2 | 3/2005 | Deckman et al. |
| 7,022,784 | B2 | 4/2006 | Wu et al. |
| 7,045,055 | B2 | 5/2006 | Ziemer et al. |
| 7,060,768 | B2 | 6/2006 | Brookhart et al. |
| 7,129,197 | B2 | 10/2006 | Song et al. |
| 7,312,185 | B2 | 12/2007 | Willey et al. |
| 7,544,850 | B2 | 6/2009 | Goze et al. |
| 7,547,811 | B2 | 6/2009 | Kramer et al. |
| 7,585,823 | B2 | 9/2009 | Sullivan et al. |
| 7,592,411 | B2 | 9/2009 | Wu et al. |
| 7,592,497 | B2 | 9/2009 | Yang et al. |
| 7,683,013 | B2 | 3/2010 | Carey et al. |
| 7,795,194 | B2 | 9/2010 | Iimura et al. |
| 2001/0041817 | A1 | 11/2001 | Bagheri et al. |
| 2001/0041818 | A1 | 11/2001 | Bagheri et al. |
| 2002/0005727 | A1 | 1/2002 | Ogimoto et al. |
| 2002/0144853 | A1 | 10/2002 | Martin |
| 2003/0013623 | A1 | 1/2003 | Tse et al. |
| 2003/0055184 | A1 | 3/2003 | Song et al. |
| 2003/0092585 | A1 | 5/2003 | O'Connor et al. |
| 2003/0158055 | A1 | 8/2003 | Deckman et al. |
| 2003/0207775 | A1 | 11/2003 | Sullivan et al. |
| 2003/0236177 | A1 | 12/2003 | Wu et al. |
| 2004/0002429 | A1 | 1/2004 | Forbus, Jr. |
| 2004/0029747 | A1 | 2/2004 | Emert et al. |
| 2004/0033908 | A1 | 2/2004 | Deckman et al. |
| 2004/0087746 | A1 | 5/2004 | Razavi |

| | | | | |
|---|---|---|---|---|
| 2004/0092408 | A1 | 5/2004 | Willey et al. | |
| 2004/0097772 | A1 | 5/2004 | Deckers et al. | |
| 2004/0147693 | A1 | 7/2004 | DiMaio | |
| 2004/0214733 | A1 | 10/2004 | Baba | |
| 2004/0220359 | A1 | 11/2004 | Abhari et al. | |
| 2004/0225088 | A1 | 11/2004 | Vaughan et al. | |
| 2004/0230016 | A1 | 11/2004 | Blackborrow et al. | |
| 2005/0059563 | A1 | 3/2005 | Sullivan et al. | |
| 2005/0101761 | A1 | 5/2005 | Lambert et al. | |
| 2005/0113621 | A1 | 5/2005 | Hope et al. | |
| 2005/0124509 | A1 | 6/2005 | Gutierrez et al. | |
| 2005/0183988 | A1 | 8/2005 | Freerks et al. | |
| 2005/0250657 | A1 | 11/2005 | Wu et al. | |
| 2006/0116300 | A1 | 6/2006 | Arrowsmith et al. | |
| 2006/0116303 | A1 | 6/2006 | Iimura et al. | |
| 2006/0122073 | A1 | 6/2006 | Hewette | |
| 2006/0131210 | A1 | 6/2006 | Rosenbaum et al. | |
| 2006/0157383 | A1 | 7/2006 | Wu et al. | |
| 2006/0178279 | A1 | 8/2006 | Sullivan et al. | |
| 2006/0270568 | A1 | 11/2006 | Kawata | |
| 2006/0276355 | A1* | 12/2006 | Carey et al. | 508/485 |
| 2006/0281643 | A1 | 12/2006 | Habeeb et al. | |
| 2007/0000807 | A1 | 1/2007 | Wu et al. | |
| 2007/0043248 | A1 | 2/2007 | Wu et al. | |
| 2007/0208151 | A1 | 9/2007 | Okada et al. | |
| 2007/0289897 | A1 | 12/2007 | Carey et al. | |
| 2008/0177121 | A1 | 7/2008 | Wu et al. | |
| 2009/0005279 | A1 | 1/2009 | Wu et al. | |
| 2009/0036725 | A1 | 2/2009 | Wu et al. | |
| 2009/0093657 | A1 | 4/2009 | Buchanan et al. | |
| 2009/0156874 | A1 | 6/2009 | Patil et al. | |
| 2009/0240012 | A1 | 9/2009 | Patil et al. | |
| 2010/0006259 | A1 | 1/2010 | Mori et al. | |
| 2010/0048438 | A1 | 2/2010 | Carey et al. | |
| 2010/0087349 | A1 | 4/2010 | Lee et al. | |
| 2010/0105585 | A1 | 4/2010 | Carey et al. | |
| 2010/0256026 | A1 | 10/2010 | Wu et al. | |
| 2010/0292424 | A1 | 11/2010 | Wu et al. | |
| 2011/0082061 | A1 | 4/2011 | Carey et al. | |
| 2011/0082063 | A1 | 4/2011 | Carey et al. | |
| 2011/0136714 | A1 | 6/2011 | Haigh et al. | |

FOREIGN PATENT DOCUMENTS

| | | | |
|---|---|---|---|
| EP | 0119792 | A1 | 9/1984 |
| EP | 0088453 | B1 | 5/1987 |
| EP | 0276320 | B1 | 8/1988 |
| EP | 0277004 | A1 | 8/1988 |
| EP | 0277007 | B1 | 8/1988 |
| EP | 0284708 | B1 | 10/1988 |
| EP | 0291006 | B1 | 11/1988 |
| EP | 0321852 | B1 | 6/1989 |
| EP | 0349276 | B1 | 1/1990 |
| EP | 0377306 | B1 | 7/1990 |
| EP | 0403866 | A1 | 12/1990 |
| EP | 0513380 | B1 | 11/1992 |
| EP | 0680942 | A1 | 5/1994 |
| EP | 0613873 | A2 | 9/1994 |
| EP | 0930320 | A1 | 7/1997 |
| EP | 1028128 | A1 | 10/1997 |
| EP | 0992517 | A2 | 9/1998 |
| EP | 1309633 | B1 | 8/2000 |
| EP | 0815187 | B1 | 5/2002 |
| EP | 1308496 | B1 | 5/2003 |
| EP | 1342707 | A2 | 9/2003 |
| EP | 1607415 | A1 | 12/2005 |
| EP | 1661921 | A1 | 5/2006 |
| GB | 938069 | | 9/1963 |
| IN | 191553 | | 12/2003 |
| JP | 6336590 | A | 12/1994 |
| JP | 200500446 | A | 7/2005 |
| WO | 9623751 | | 8/1996 |
| WO | 9804658 | | 2/1998 |
| WO | 9967347 | | 6/1999 |
| WO | 0058423 | | 10/2000 |
| WO | WO 00/58423 | | 10/2000 |
| WO | 0214384 | A2 | 2/2002 |
| WO | WO 03/009136 | A1 | 1/2003 |
| WO | 03020856 | A1 | 3/2003 |
| WO | 03051943 | A1 | 6/2003 |
| WO | WO 03/071369 | A1 | 8/2003 |
| WO | 03104292 | A1 | 12/2003 |
| WO | 2004046214 | A2 | 6/2004 |
| WO | 2004053030 | A2 | 6/2004 |
| WO | 2005111178 | A1 | 12/2005 |
| WO | 2006071595 | A2 | 7/2006 |
| WO | 2006083632 | A1 | 8/2006 |
| WO | 2007005094 | A1 | 1/2007 |
| WO | 2007011462 | A1 | 1/2007 |
| WO | WO 2007/011459 | A1 | 1/2007 |
| WO | WO 2007/011832 | A1 | 1/2007 |
| WO | WO 2007/145924 | A1 | 12/2007 |
| WO | WO 2007/146081 | A1 | 12/2007 |
| WO | WO 2008/010865 | A2 | 1/2008 |
| WO | 2009017953 | A2 | 2/2009 |
| WO | 2009123800 | A1 | 10/2009 |
| WO | 2009137264 | A1 | 11/2009 |

OTHER PUBLICATIONS

"Synthetic Lubricants and High-Performance Functional Fluids," edited by Leslie R. Rudnick, et al., pp. 195-213, Marcel Dekker, Inc., New York, 1999.

"Synthetic Lubricants and High-Performance Functional Fluids," edited by Leslie R. Rudnick, et al., pp. 499-518 and pp. 519-538, Marcel Dekker, Inc., New York, 1999.

J. Brennan, "Wide-Temperature Range Synthetic Hydrocarbon Fluids", Ind. Eng. Chem. Prod. Res. Dev., 1980, vol. 19, pp. 2-6.

K. Denbigh, "The Kinetics of Continuous Reaction Processes: Application to Polymerization", J. Applied Chem, 1951, vol. 1, pp. 227-236.

K. Denbigh, "Continuous Reactions: Part II. The Kinetics of Steady State Polymerisation", Trans Faraday Soc., 1947, vol. 43, pp. 648-660.

A. Munoz-Escalona, et al., "Single-Site Supported Catalysts for Ethylene Polymerization", Metallocene Tech., 1999, pp. 2242-2246.

Z. Fan, et al., "Effect of Ethoxy- and Methoxysilane Donors in Propene/1-Hexene Copolymerization with High-Yield Supported Ziegler-Natta Catalysts", Macromolecular Chemistry and Physics, 1994, vol. 195, pp. 3889-3899.

G. Gokel, ed., "Dean's Handbook of Organic Chemistry", 2nd Edition, McGraw-Hill, 2004, available on-line at hhtp://knovel.com.

M. LeVan, et al., "Adsorption and Ion Exchange", Perry's Chemical Engineer's Handbook, 7th ed., 1997, pp. 16-1-16-66.

O. Levenspiel, "Ch. 7: Design for Multiple Reactions", Chemical Reaction Engineering, 2nd ed., 1972, pp. 196-209.

N. Naga, et al., "Effect of Co-Catalyst System on a-Olefin Polymerization with Rac- and Meso-[Dimethylsilylenebis (2,3,5-Trimethyl-Cyclopentadienyl)] Zirconium Dichloride", Macromol. Rapid Commun., 1997, vol. 18, pp. 581-589.

N. Naga, et al., "Polymerization Behavior of a-Olefins with Rac- and Meso-Type Ansa-Metallocene Catalyst: Effects of Cocatalyst and Metallocene Ligand", Macromolecular Chemistry Physics, 1999, vol. 200, pp. 1587-1594.

F. Rodriguez, "The Molecular Weight of Polymers", Principles of Polymer Systems, 1970, Chapter 6, pp. 115-144.

M. Sacchi, et al., "Use of Different Alkoxysilanes as External Donors in MgCl2-Supported Ziegler-Natta Catalysts to Obtain Propene/1-Butene Copolymers with Different Microstructure", Macromolecular Chemistry and Physics, 1994, vol. 195, pp. 2805-2816.

T. Seraidaris, et al., "High-Molar-Mass Polypropene with Tunable Elastic Properties by Hafnocene/Borate Catalysts", Journal of Polymer Science: Part A: Polymer Chemistry, 2006, vol. 44, pp. 4743-4751.

J. Wills, "Synthetic Lubricants", Lubrication Fundamentals, Marcel Dekker Inc., New York, 1980, pp. 75-80.

"Mobil Releases SuperSyn PAO's", Lubrication Engineers, 1999, vol. 55, Part 8, pp. 45.

TIBA data, "TIBA datasheet" available on-line at www.albermarle.com on Aug. 26, 2010.

ASTM D3427-03, "Standard Test Method for Air Release Properties of Petroleum Oils", Oct. 2002.

http://www.mobil.com/USA, Mobilgear®SHC XMP Series, Jun. 2005.
http://www.famm11c.comffamm/lubricant_productasp?gearoils &&wPinnacleMarineGear220, Pinnacle® Marine Gear 220, Nov. 19, 2007.
Rudnick, Leslie R., "Synthetics, Mineral Oils, and Bio-Based Lubricants Chemistry and Technology", published by CRC Press, Taylor & Francis Group, 2006, 37-46.
Corsico, G., et al., "Poly(internal olefins)", Euron, Milan, Italy, Chemical Industries (Dekker), 1999, 77(Synthetic Lubricants and High-Performance Functional Fluids, 2nd Edition, 53-62.
Kirk-Othmer Encyclopedia of Chemcial Technology, Second completely revised edition, "Diamines and Higher Amines, Aliphatic", vol. 7, 1965, published by John Wiley & Sons, Inc., 22-39.

* cited by examiner

HVI-PAO BI-MODAL LUBRICANT COMPOSITIONS

CROSS-REFERENCE TO RELATED APPLICATION(S)

Non Provisional Application based on U.S. Ser. No. 61/195,153 filed Oct. 3, 2008.

FIELD OF THE INVENTION

The invention relates to lubricant compositions containing high viscosity index polyalphaolefins (HVI-PAO).

BACKGROUND OF THE INVENTION

Polyalphaolefins (PAOs) of different viscosity grades are known to be useful in synthetic and semi-synthetic industrial oil and grease formulations. See, for instance, Chapters 22 and 23 in Rudnick et al., "Synthetic Lubricants and High-Performance Functional Fluids", 2nd Ed. Marcel Dekker, Inc., N.Y. (1999). Compared to the conventional mineral oil-based products, these PAO-based products have excellent viscometrics, high and low temperature performance and energy efficiency under routine conditions and ordinary replacement schedules.

The viscosity-temperature relationship of a lubricating oil is one of the critical criteria, which must be considered when selecting a lubricant for a particular application. Viscosity Index (VI) is an empirical, unitless number which indicates the rate of change in the viscosity of an oil within a given temperature range. Fluids exhibiting a relatively large change in viscosity with temperature are said to have a low viscosity index. A low VI oil, for example, will thin out at elevated temperatures faster than a high VI oil. Usually, the high VI oil is more desirable because it has higher viscosity at higher temperature, which translates into better or thicker lubrication films and better protection of the contacting machine elements. In another aspect, as the oil operating temperature decreases, the viscosity of a high VI oil will not increase as much as the viscosity of a low VI oil. This is advantageous because the excessively high viscosity of the low VI oil will decrease the efficiency of the operating machine. Thus a high VI oil has performance advantages in both high and low temperature operation. VI is determined according to ASTM method D 2270-93 [1998]. VI is related to kinematic viscosities measured at 40° C. and 100° C. using ASTM Method D 445-01.

PAOs comprise a class of hydrocarbons manufactured by the catalytic oligomerization (polymerization to low molecular weight products) of linear α-olefins typically ranging from 1-hexene to 1-octadecene, more typically from 1-octene to 1-dodecene, with 1-decene as the most common and often preferred material. Examples of these fluids are described, by way of example, in U.S. Pat. Nos. 6,824,671 and 4,827,073, although polymers of lower olefins such as ethylene and propylene may also be used, especially copolymers of ethylene with higher olefins, as described in U.S. Pat. Nos. 4,956,122 or 4,990,709 and the patents referred to therein.

High viscosity index polyalphaolefin (HVI-PAO) are prepared by, for instance, polymerization of alpha-olefins using reduced metal oxide catalysts (e.g., chromium) such as described in U.S. Pat. Nos. 4,827,064; 4,827,073; 4,990,771; 5,012,020; and 5,264,642. These HVI-PAOs are characterized by having a high viscosity index (VI) and one or more of the following characteristics: a branch ratio of less than 0.19, a weight average molecular weight of between 300 and 45,000, a number average molecular weight of between 300 and 18,000, a molecular weight distribution of between 1 and 5, and pour point below −15° C. Measured in carbon number, these molecules range from C30 to C1300. Viscosities of the HVI-PAO oligomers measured at 100° C. range from 3 centistokes ("cSt") to 15,000 cSt. These HVI-PAOs have been used as base stocks since their commercial production and are commercially available, such as for instance SpectraSyn Ultra™ fluid, from ExxonMobil Chemical Co.

Another advantageous property of these HVI-PAOs is that, while lower molecular weight unsaturated oligomers are typically and preferably hydrogenated to produce thermally and oxidatively stable materials, higher molecular weight unsaturated HVI-PAO oligomers useful as lubricant are sufficiently thermally and oxidatively stable to be utilized without hydrogenation and, optionally, may be so employed.

HVI-PAO materials have been used for formulating oils for internal combustion engines. By way of example, WO 00/58423 teaches high performance oil comprising a first and second polymer of differing molecular weights dissolved in a base stock of low viscosity. The first polymer is a high viscoelastic polymer, preferably an HVI-PAO. The base stock used generally has a viscosity of below 10 cSt at 100° C. The HVI-PAO is "normally present in relatively small amounts", e.g., 0.1 to about 25 wt % in the total finished product. Also included in the finished product is a polymeric thickener, normally based on block copolymers produced by the anionic polymerization of unsaturated monomers including styrene, butadiene, and isoprene. A "conventional" additive package, containing dispersant, detergents, anti-wear, or antioxidants such as phenolic and/or amine type antioxidants is also added.

See also U.S. Pat. Nos. 4,180,575; 4,827,064; 4,827,073; 4,912,272; 4,990,771; 5,012,020; 5,264,642; 6,087,307; 6,180,575; WO 03/09136; WO 2003071369A; U.S. Patent Application No. 2005/0059563; and Lubrication Engineers, 55/8, 45 (1999).

Industrial gear oils have to meet the following requirements: excellent resistance to aging and oxidation, low foaming tendency, good load-carrying capacity, neutrality toward the materials involved (ferrous and nonferrous metals, seals, paints), suitability for high and/or low temperatures, and good viscosity-temperature behavior; gear greases, in contrast, are required to ensure the following: good adhesion, low oil separation, low starting torques, compatibility with synthetic materials, and noise dampening (c.f., Rudnick et al., supra). Heretofore, a universal gear lubricant meeting all these requirements is not, as far as the present inventors are aware, commercially available. This requires that lubricant manufacturers develop different types of formulations with properties satisfying individual operating needs for each application.

Industry is developing a very high viscosity index (VI) finished gear lubricants comprising Group IV and Group V base fluids. Many of these next generation gear lubricants utilize chrome-silica catalyst derived 150 cSt PAO. This very high viscosity index Group TV base oil, when combined with very low viscosity base oil components (PAO 2 and a polar Group V base stock) has displayed distinct efficiency and VI advantages over prior art synthetic gear lubricants. It is understood that the high VI and wide bi-modal viscosity distribution of the components contributes significantly to the fluid performance advantages.

One area for improvement to this bi-modal base fluid system is the relative shear instability of the high viscosity Group IV base stock—150 cSt PAO. Current formulation options using 150 cSt SuperSyn™ utilize 40-50% of this component in the finished fluid. Due to the rather wide molecular weight distribution of the existing chrome-silica derived SuperSyn base stocks (cs-SuperSyn), some shear instability is observed in traditional lubricant shear tests (KRL 20 hr Bearing Shear Test/CEC L-45-A-99). This shear instability may lead to overall permanent viscous losses of the finished fluid.

There is a need to improve shear stability in bi-modal lubricant formulations. Accordingly, this inventions satisfies that need.

SUMMARY OF THE INVENTION

The invention is directed to oil formulations comprising a high viscosity index polyalphaolefin (HVI-PAO). In one embodiment the oil formulation comprises a metallocene catalyzed HVI-PAO with a viscosity greater than 125 cSt kv 100° C. and a viscosity index greater than 100, a second base stock with a viscosity of at least 2 cSt kv 100° C. and less than 60 cSt kv 100° C. wherein the second base stock is at least 60 cSt kv 100° C. less than the metallocene HVI-PAO, an ester with a viscosity of at least 2 and less than 6, the ester comprising more than 10 weight percent and less than 30 weight percent of the oil formulation, the oil formulation having a viscosity index of greater than 195.

In a second embodiment, a method to improve shear stability is disclosed. In this embodiment, the method comprises obtaining an oil formulation comprising a metallocene HVI-PAO with a viscosity greater than 125 cSt kv 100° C. and a viscosity index greater than 195, a second base stock with a viscosity of at least 2 cSt kv 100° C. and less than 60 cSt kv 100° C. wherein the second base stock is at least 60 cSt kv 100° C. less than the metallocene HVI-PAO, an ester with a viscosity of at least 2 and less than 6, the ester comprising more than 10 weight percent and less than 30 weight percent of the oil formulation and lubricating with the oil formulation.

In a third embodiment, a method of blending an oil formulation with favorable shear stability is disclosed. This method comprises obtaining a metallocene HVI-PAO with a viscosity greater than 100 cSt kv 100° C. and a viscosity index greater than 100, obtaining a second base stock with a viscosity of at least 2 cSt kv 100° C. and less than 60 cSt kv 100° C. wherein the second base stock is at least 60 cSt kv 100° C. less than the metallocene HVI-PAO, obtaining an ester with a viscosity of at least 2 and less than 6, the ester comprising more than 10 weight percent and less than 30 weight percent of the oil formulation; and blending the metallocene HVI-PAO with the second base stock and ester to formulate an oil formulation with favorable shear stability.

DETAILED DESCRIPTION

Figure 1:
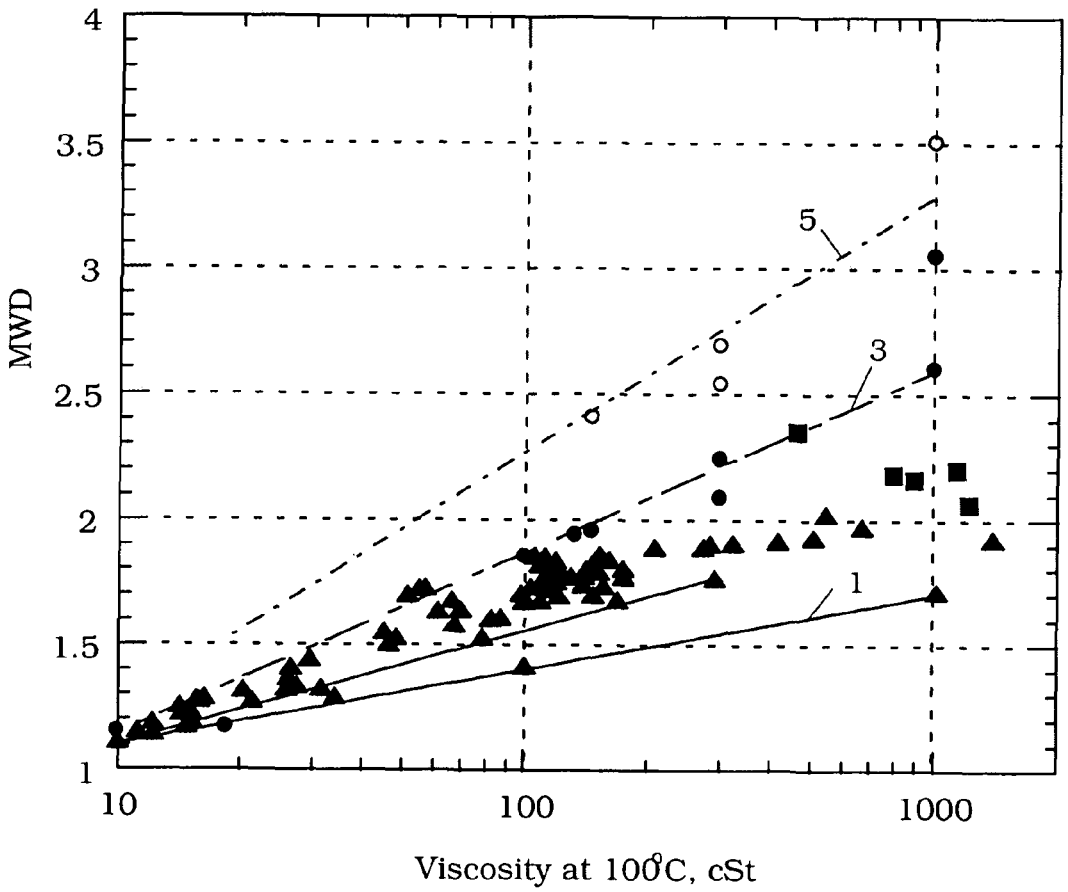
FIG. 1 is a graph illustrating the molecular weight distribution of high viscosities PAO.

According to the invention, formulations for use as oils are provided comprising a high viscosity index PAO (HVI-PAO). We have discovered the use of metallocene-catalyst derived PAOs surprisingly greatly reduces, if not eliminates permanent viscosity losses due to shearing in bi-modal formulations. It is understood that the very narrow molecular weight distribution of the m-PAO may provide some enhancement to shear stability of this high viscosity base stock, but the high degree of benefit observed in the testing was unexpected. This property, coupled with the availability of other shear-stable higher viscosity states of m-PAO, allows formulators to widen the bi-modal blending concept for further improvements in VI and improved gear lubricant efficiency. In addition, this discovery is applicable to other viscosity versions of mPAO preferably above 125 cSt and more preferably in the 150-600 cSt range using metallocene catalyst.

The use of very high viscosity, shear stable base stocks allows for the formulation of extremely high VI, wide bi-modal formulations which exhibit little to no shear losses. Current technology requires the use of high viscosity olefin co-polymers ("OCP") or poly-iso butylene ("PIB") viscosity modifiers to increase viscosity. These viscosity modifiers are shear unstable and exhibit permanent shear viscosity losses due to mechanical shearing. In one embodiment, this invention eliminates the need for these components and in some embodiments eliminates the need for any viscosity modifiers, and provides favorable gear efficiency.

The HVI-PAOs useful in the present invention are characterized by having a high viscosity index (VI), preferably 160 or greater, more preferably greater than 180, and still more preferably 195 or greater, yet more preferably 200 or greater, and yet still more preferably 250 or greater. An upper limit on VI, while not critical to the characterization of HVI-PAOs useful in the present invention, is about 350. VI as used herein are measured according to ASTM D2270.

The HVI-PAOs generally can be further characterized by one or more of the following: C30-C1300 hydrocarbons, a branch ratio of less than 0.19, a weight average molecular weight of between 300 and 45,000, a number average molecular weight of between 300 and 18,000, a molecular weight distribution of between 1 and 5.

Particularly preferred HVI-PAOs are fluids with 100° C. kinematic viscosity ranging from 5 to 3000 centistokes (cSt). The term "kinematic viscosity" as used herein will be referred to simply as viscosity, unless otherwise noted, and will be the viscosity determined according to ASTM D445 at the temperature specified, usually 100° C. When no temperature is mentioned, 100° C. should be inferred.

In embodiments, viscosities of the HVI-PAO oligomers measured at 100° C. range from 3 cSt to 15,000 cSt, or 3 cSt to 5,000 cSt, or 3 cSt to 1000 cSt, or 725 cSt to 15,000 cSt, or 20 cSt to 3000 cSt.

The HVI-PAOs may be further characterized, in an embodiment, by a low pour point, generally below −15° C., as determined by ASTM D97.

The term "PAO" in HVI-PAOs means, as is generally accepted in the art, an oligomer (low molecular weight polymer) of one or more alpha olefins, such as 1-decene. In embodiments, the HVI-PAOs of the invention may be further characterized as hydrocarbon compositions comprising the oligomers of one or more 1-alkenes selected from C6-C36 1-alkenes, more preferably C6-C20, still more preferably C6-C14. Examples of the feeds can be 1-hexene, 1-octene, 1-decene, 1-dodecene, 1-tetradecene, etc., or mixtures thereof, such as one or more of C6 to C36 1-alkenes, or one or more C6 to C20 1-alkenes, or one or more C6 to C14 alkenes, or mixtures of specific 1-alkenes, such as a mixture of C6 and C12 1-alkenes, a mixture of C6 and C14 1-alkenes, a mixture of C6 and C16 1-alkenes, a mixture of C6 and C18 1-alkenes, a mixture of C8 and C10 1-alkenes, a mixture of C8 and C12 1-alkenes, or a feed comprising at least two 1-alkenes selected from the group consisting of C8, C10 and C12 1-alkenes, and so forth, although oligomers of lower olefins such as ethylene and propylene may also be used, including copolymers of ethylene with higher olefins, as described in U.S. Pat. No. 4,956,122.

Preferred methods of making the HVI-PAO fluids useful in the present invention can be made from several process catalysts. Example catalysts are supported solid reduced Group VIB metal (e.g. chromium) catalyst under oligomerization conditions at a temperature of about room temperature to 250° C., or metallocene catalysts. Numerous patents describe the preparation of HVI-PAO useful in the present invention, such as U.S. Pat. Nos. 4,827,064; 4,827,073; 4,912,272; 4,914,254; 4,926,004; 4,967,032; and 5,012,020. Additional methods of preparing a HVI-PAO useful in the present invention are described herein.

In preferred embodiments for preparation of HVI-PAOs useful in the present invention, the lube products usually are distilled to remove any low molecular weight compositions such as those boiling below about 600° F. (about 315° C.), or with carbon number less than C20, if they are produced from the polymerization reaction or are carried over from the starting material. This distillation step usually improves the volatility of the finished fluids. In certain special applications, or when no low boiling fraction is present in the reaction mixture, this distillation is not necessary. Thus, in preferred embodiments, the whole reaction product after removing any solvent or starting material can be used as lube base stock or for the further treatments.

The lube fluids made directly from the polymerization or oligomerization process usually have unsaturated double bonds or have olefinic molecular structure. The amount of double bonds or unsaturation or olefinic components can be measured by several methods, such as bromine number (ASTM 1159), bromine index (ASTM D2710) or other suitable analytical methods, such as NMR, IR, and the like, well-known per se to one of ordinary skill in the art. The amount of the double bond or the amount of olefinic compositions depends on several factors—the degree of polymerization, the amount of hydrogen present during the polymerization process and the amount of other promoters which participate in the termination steps of the polymerization process, or other agents present in the process. Usually, the amount of double bonds or the amount of olefinic components is decreased by the higher degree of polymerization, the higher amount of hydrogen gas present in the polymerization process, or the higher amount of promoters participating in the termination steps.

Oxidative stability and light or UV stability of fluids usually improves when the amount of unsaturation double bonds or olefinic contents is reduced. Therefore in preferred embodiments, it is necessary to further hydrotreat the polymer if they have high degree of unsaturation. Usually, the fluids with bromine number of less than 5, as measured by ASTM D1159, is suitable for high quality base stock applications of the invention. Fluids with bromine number of less than 3 or 2 are preferred. The most preferred range is less than 1 or less than 0.1.

In embodiments, the lube products in the production of the HVI-PAOs are hydrotreated to reduce unsaturation. This may be done by methods well-known per se in literature (e.g., U.S. Pat. No. 4,827,073, example 16). In some HVI-PAO products, the fluids made directly from the polymerization already have very low degree of unsaturation, such as those with viscosities greater than 150 cSt at 100° C. They have bromine numbers less than 5 or even below 2. in these cases, the direct product may be used without hydrotreating. Thus, hydrotreatment of the HVI-PAO product is optional, depending on the method used to make the HVI-PAO and the end use.

Viscosities of base stocks used to formulate lubricants have critical effect on finished lubricant performance. For example, high speed and lightly loaded plain bearings can use a low viscosity lubricant. The viscosity film generated by such low viscosity fluid is enough to ensure hydrodynamic lubrication. However, higher loadings and lower speed equipment requires higher viscosity oils to provide stronger and thicker lubricating film for protection. There are many ways to achieve wide viscosity range, blending of commonly available low viscosity fluids, such as the 100 SUS solvent-refined base stocks or low viscosity Group IV or Group V base stocks, with high viscosity fluids, such as the commonly available bright stock, high viscosity PAO, such as SpectraSyn™ 100 fluid, high viscosity polyisobutylenes, or with viscosity improvers or viscosity index improvers. The quality of the high viscosity base stock is critical to the property and the performance of the finished lubricants.

The lube base stocks used in lubricant formulations comprise at least some amount of single viscosity grade or a mixture of several viscosity grades of HVI-PAO fluids. The total HVI-PAO composition can ranged from 1% to 99 wt %, depending on the desirable viscosity grades of the finished lube, the starting viscosity grade of the HVI-PAO or the viscosities of other components present in the finished lube. In preferred embodiments, the amount of HVI-PAO present can range from 1 to 90 wt %, or 15 to 50 wt %, or 15 to 45 wt %, or 50 to 99 wt %, or 50 to 90 wt %, or 55 to 90 wt %.

Basestocks that may be blended with the HVI-PAOs of the invention include those that fall into any of the well-known American Petroleum Institute (API) categories of Group I through Group V. The API defines Group I stocks as solvent-refined mineral oils. Group I stocks contain the least saturates and highest amount of sulfur and generally have the lowest viscosity indices. Group I defines the bottom tier of lubricant performance. Group II and III stocks are high viscosity index and very high viscosity index base stocks, respectively. The Group III oils generally contain fewer unsaturates and sulfur than the Group II oils. With regard to certain characteristics, both Group II and Group III oils perform better than Group I oils, particularly in the area of thermal and oxidative stability.

Group IV stocks consist of polyalphaolefins, which are produced via the catalytic oligomerization of linear alphaolefins (LAOs), particularly LAOs selected from C5-C14 alphaolefins, preferably from 1-hexene to 1-tetradecene, more preferably from 1-octene to 1-dodecene, and mixtures thereof, with 1-decene being the preferred material, although oligomers of lower olefins such as ethylene and propylene, oligomers of ethylene/butene-1 and isobutylene/butene-1, and oligomers of ethylene with other higher olefins, as described in U.S. Pat. No. 4,956,122 and the patents referred to therein, and the like may also be used. PAOs offer superior volatility, thermal stability, and pour point characteristics to those base oils in Group I, II, and III.

Group V includes all the other base stocks not included in Groups I through IV. Group V base stocks includes the important group of lubricants based on or derived from esters. It also includes alkylated aromatics, polyalkylene glycols (PAGs), etc.

Particularly preferred base stocks to blend with HVI-PAO include the API Group I base stocks with viscosity ranging from 3 cSt to 50 cSt, Group II and III hydroprocessed base stocks (see, for example, U.S. Pat. Nos. 5,885,438, 5,643,440, and 5,358,628), Group IV PAOs such as those described in U.S. Pat. Nos. 4,149,178, and 3,742,082, and fluids prepared from polymerization of internal olefins (also named polyinternal olefins or PIO), or lubes produced from Fischer-Tropsch hydrocarbon synthesis process followed by suitable hydroisomerization process as described in U.S. Pat. No. 6,332,974.

Metallocene Base Stocks

In one embodiment, the metallocene catalyzed PAO (or mPAO) used for this invention can be a co-polymer made from at least two alpha-olefins or more, or a homo-polymer made from a single alpha-olefin feed by a metallocene catalyst system.

This copolymer mPAO composition is made from at least two alpha-olefins of C3 to C30 range and having monomers randomly distributed in the polymers. It is preferred that the average carbon number is at least 4.1. Advantageously, ethylene and propylene, if present in the feed, are present in the amount of less than 50 wt % individually or preferably less than 50 wt % combined. The copolymers of the invention can be isotactic, atactic, syndiotactic polymers or any other form of appropriate tacticity. These copolymers have useful lubricant properties including excellent VI, pour point, and low temperature viscometrics by themselves or as blend fluid with other lubricants or other polymers. Furthermore, these copolymers have narrow molecular weight distributions and excellent lubricating properties.

In an embodiment, mPAO is made from the mixed feed LAOs comprising at least two and up to 26 different linear alpha-olefins selected from C3 to C30 linear alpha-olefins. In a preferred embodiment, the mixed feed LAO is obtained from an ethylene growth process using an aluminum catalyst or a metallocene catalyst. The growth olefins comprise mostly C6 to C18-LAO. LAOs from other process, such as the SHOP process, can also be used.

This homo-polymer mPAO composition is made from single alpha-olefin choosing from C3 to C30 range, preferably C3 to C16, most preferably C3 to C 14 or C3 to C 12. The homo-polymers of the invention can be isotactic, atactic, syndiotactic polymers or any combination of these tacticity or other form of appropriate tacticity. Often the tacticity can be carefully tailored by the polymerization catalyst and polymerization reaction condition chosen or by the hydrogenation condition chosen. These homo-polymers have useful lubricant properties including excellent VI, pour point, and low temperature viscometrics by themselves or as blend fluid with other lubricants or other polymers. Furthermore, these homo-polymers have narrow molecular weight distributions and excellent lubricating properties.

In another embodiment, the alpha-olefin(s) can be chosen from any component from a conventional LAO production facility or from refinery. It can be used alone to make homo-polymer or together with another LAO available from refinery or chemical plant, including propylene, 1-butene, 1-pentene, and the like, or with 1-hexene or 1-octene made from dedicated production facility. In another embodiment, the alpha-olefins can be chosen from the alpha-olefins produced from Fischer-Trosch synthesis (as reported in U.S. Pat. No. 5,382,739). For example, C3 to C16-alpha-olefins, more preferably linear alpha-olefins, are suitable to make homo-polymers. Other combinations, such as C4 and C14-LAO; C6 and C16-LAO; C8, C10, C12-LAO; or C8 and C14-LAO; C6, C10, C14-LAO; C4 and C12-LAO, etc. are suitable to make co-polymers.

The activated metallocene catalyst can be simple metallocenes, substituted metallocenes or bridged metallocene catalysts activated or promoted by, for instance, methylaluminoxane (MAO) or a non-coordinating anion, such as N,N-dimethylanilinium tetrakis(perfluorophenyl)borate or other equivalent non-coordinating anion and optionally with co-activators, typically trialkylaluminum compounds.

According to the invention, a feed comprising a mixture of LAOs selected from C3 to C30 LAOs or a single LAO selected from C3 to C16 LAO, is contacted with an activated metallocene catalyst under oligomerization conditions to provide a liquid product suitable for use in lubricant components or as functional fluids. This invention is also directed to a copolymer composition made from at least two alpha-olefins of C3 to C30 range and having monomers randomly distributed in the polymers. The phrase "at least two alpha-olefins" will be understood to mean "at least two different alpha-olefins" (and similarly "at least three alpha-olefins" means "at least three different alpha-olefins", and so forth).

In preferred embodiments, the average carbon number (defined hereinbelow) of said at least two alpha-olefins in said feed is at least 4.1. In another preferred embodiment, the amount of ethylene and propylene in said feed is less than 50 wt % individually or preferably less than 50 wt % combined. A still more preferred embodiment comprises a feed having both of the aforementioned preferred embodiments, i.e., a feed having an average carbon number of at least 4.1 and wherein the amount of ethylene and propylene is less than 50 wt % individually.

In embodiments, the product obtained is an essentially random liquid copolymer comprising the at least two alpha-olefins. By "essentially random" is meant that one of ordinary skill in the art would consider the products to be random copolymer. Other characterizations of randomness, some of which are preferred or more preferred, are provided herein. Likewise the term "liquid" will be understood by one of ordinary skill in the art, but more preferred characterizations of the term are provided herein. In describing the products as "comprising" a certain number of alpha-olefins (at least two different alpha-olefins), one of ordinary skill in the art in possession of the present disclosure would understand that what is being described in the polymerization (or oligomerization) product incorporating said certain number of alpha-olefin monomers. In other words, it is the product obtained by polymerizing or oligomerizing said certain number of alpha-olefin monomers.

This improved process employs a catalyst system comprising a metallocene compound (Formula 1, below) together with an activator such as a non-coordinating anion (NCA) (Formula 2, below) and optionally a co-activator such as a trialkylaluminum, or with methylaluminoxane (MAO) (Formula 3, below).

Formula 1

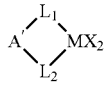

Formula 2

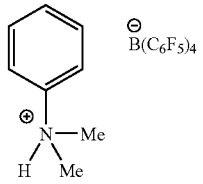

NCA

-continued

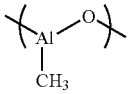

MAO

Formula 3

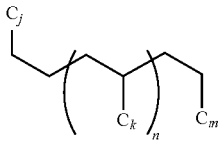

The term "catalyst system" is defined herein to mean a catalyst precursor/activator pair, such as a metallocene/activator pair. When "catalyst system" is used to describe such a pair before activation, it means the unactivated catalyst (pre-catalyst) together with an activator and, optionally, a co-activator (such as a trialkyl aluminum compound). When it is used to describe such a pair after activation, it means the activated catalyst and the activator or other charge-balancing moiety. Furthermore, this activated "catalyst system" may optionally comprise the co-activator and/or other charge-balancing moiety. Optionally and often, the co-activator, such as trialkylaluminum compound, is also used as impurity scavenger.

The metallocene is selected from one or more compounds according to Formula 1, above. In Formula 1, M is selected from Group 4 transition metals, preferably zirconium (Zr), hafnium (Hf) and titanium (Ti), L1 and L2 are independently selected from cyclopentadienyl ("Cp"), indenyl, and fluorenyl, which may be substituted or unsubstituted, and which may be partially hydrogenated, A can be no atom, as in many un-bridged metallocenes or A is an optional bridging group which if present, in preferred embodiments is selected from dialkylsilyl, dialkylmethyl, diphenylsilyl or diphenylmethyl, ethylenyl (—CH2-CH2-), alkylethylenyl (—CR2-CR2-), where alkyl can be independently C1 to C16 alkyl radical or phenyl, tolyl, xylyl radical and the like, and wherein each of the two X groups, Xa and Xb, are independently selected from halides, OR(R is an alkyl group, preferably selected from C1 to C5 straight or branched chain alkyl groups), hydrogen, C1 to C16 alkyl or aryl groups, haloalkyl, and the like. Usually relatively more highly substituted metallocenes give higher catalyst productivity and wider product viscosity ranges and are thus often more preferred.

In another embodiment, any of the polyalpha-olefins produced herein preferably have a Bromine number of 1.8 or less as measured by ASTM D 1159, preferably 1.7 or less, preferably 1.6 or less, preferably 1.5 or less, preferably 1.4 or less, preferably 1.3 or less, preferably 1.2 or less, preferably 1.1 or less, preferably 1.0 or less, preferably 0.5 or less, preferably 0.1 or less.

In another embodiment, any of the polyalpha-olefins produced herein are hydrogenated and have a Bromine number of 1.8 or less as measured by ASTM D 1159, preferably 1.7 or less, preferably 1.6 or less, preferably 1.5 or less, preferably 1.4 or less, preferably 1.3 or less, preferably 1.2 or less, preferably 1.1 or less, preferably 1.0 or less, preferably 0.5 or less, preferably 0.1 or less.

In another embodiment, any of the polyalpha-olefins described herein may have monomer units represented by the formula, in addition to the all regular 1,2-connection.

where j, k and m are each, independently, 1, 2, 3, 4, 5, 6, 7, 8, 9, 10, 11, 12, 13, 14, 15, 16, 17, 18, 19, 20, 21, or 22, n is an integer from 1 to 350 (preferably 1 to 300, preferably 5 to 50) as measured by proton NMR In another embodiment, any of the polyalpha-olefins described herein preferably have an Mw (weight average molecular weight) of 100,000 or less, preferably between 100 and 80,000, preferably between 250 and 60,000, preferably between 280 and 50,000, preferably between 336 and 40,000 g/mol.

In another embodiment, any of the polyalpha-olefins described herein preferably have a Mn (number average molecular weight) of 50,000 or less, preferably between 200 and 40,000, preferably between 250 and 30,000, preferably between 500 and 20,000 g/mole.

In another embodiment, any of the polyalpha-olefins described herein preferably have a molecular weight distribution (MWD=Mw/Mn) of greater than 1 and less than 5, preferably less than 4, preferably less than 3, preferably less than 2.5. The MWD of mPAO is always a function of fluid viscosity. Alternately any of the polyalpha-olefins described herein preferably have an Mw/Mn of between 1 and 2.5, alternately between 1 and 3.5, depending on fluid viscosity.

The Mw, Mn and Mz are measured by GPC method using a column for medium to low molecular weight polymers, tetrahydrofuran as solvent and polystyrene as calibration standard, correlated with the fluid viscosity according to a power equation.

In a preferred embodiment of this invention, any PAO described herein may have a pour point of less than 0° C. (as measured by ASTM D 97), preferably less than −10° C., preferably less than −20° C., preferably less than −25° C., preferably less than −30° C., preferably less than −35° C., preferably less than −50°, preferably between −10 and −80° C., preferably between −15° C. and −70° C.

In a preferred embodiment of this invention, any PAO described herein may have a kinematic viscosity (at 40° C. as measured by ASTM D 445) from about 4 to about 50,000 cSt, preferably from about 5 cSt to about 30,000 cSt at 40° C., alternately from about 4 to about 100,000 cSt, preferably from about 6 cSt to about 50,000 cSt, preferably from about 10 cSt to about 30,000 cSt at 40° C.

In another embodiment, any polyalpha-olefin described herein may have a kinematic viscosity at 100° C. from about 1.5 to about 5,000 cSt, preferably from about 2 to about 3,000 cSt, preferably from about 3 cSt to about 1,000 cSt, more preferably from about 4 cSt to about 1,000 cSt, and yet more preferably from about 8 cSt to about 500 cSt as measured by ASTM D445. The PAOs preferably have viscosities in the range of 2 to 500 cSt at 100° C. in one embodiment, and from 2 to 3000 cSt at 100° C. in another embodiment, and from 3.2 to 300 cSt in another embodiment. Alternately, the polyalpha-olefin has a KV100 of less than 200 cSt.

In another embodiment, any polyalpha olefin described herein may have a kinematic viscosity at 100° C. from 3 to 10 cSt and a flash point of 150° C. or more, preferably 200° C. or more (as measured by ASTM D 56).

In another embodiment, any polyalpha olefin described herein may have a dielectric constant of 2.5 or less (1 kHz at 23° C. as determined by ASTM D 924).

In another embodiment, any polyalpha olefin described herein may have a specific gravity of 0.75 to 0.96 g/cm$^3$, preferably 0.80 to 0.94 g/cm$^3$.

In another embodiment, any polyalpha olefin described herein may have a viscosity index (VI) of 100 or more, preferably 120 or more, preferably 130 or more, alternately, form 120 to 450, alternately from 100 to 400, alternately from 120 to 380, alternately from 100 to 300, alternately from 140 to 380, alternately from 180 to 306, alternately from 252 to 306, alternately the viscosity index is at least about 165, alternately at least about 187, alternately at least about 200, alternately at least about 252. For many lower viscosity fluids made from 1-decene or 1-decene equivalent feeds (KV100° C. of 3 to 10 cSt), the preferred VI range is from 100 to 180. Viscosity index is determined according to ASTM Method D 2270-93 [1998].

All kinematic viscosity values reported for fluids herein are measured at 100° C. unless otherwise noted. Dynamic viscosity can then be obtained by multiplying the measured kinematic viscosity by the density of the liquid. The units for kinematic viscosity are in m$^2$/s, commonly converted to cSt or centistokes (1 cSt=10−6 m$^2$/s or 1 cSt=1 mm$^2$/sec).

One embodiment is a new class of poly-alpha-olefins, which have a unique chemical composition characterized by a high degree of linear branches and very regular structures with some unique head-to-head connections at the end position of the polymer chain. The polyalpha-olefins, whether homo-polymers or co-polymers, can be isotactic, syndiotactic or atactic polymers, or have combination of the tacticity. The new poly-alpha-olefins when used by themselves or blended with other fluids have unique lubrication properties.

Another embodiment is a new class of hydrogenated poly-alpha-olefins having a unique composition which is characterized by a high percentage of unique head-to-head connection at the end position of the polymer and by a reduced degree tacticity compared to the product before hydrogenation. The new poly-alpha-olefins when used by itself or blended with another fluid have unique lubrication properties.

This improved process to produce these polymers employs metallocene catalysts together with one or more activators (such as an alumoxane or a non-coordinating anion) and optionally with co-activators such as trialkylaluminum compounds. The metallocene catalyst can be a bridged or unbridged, substituted or unsubstituted cyclopentadienyl, indenyl or fluorenyl compound. One preferred class of catalysts are highly substituted metallocenes that give high catalyst productivity and higher product viscosity. Another preferred class of metallocenes are bridged and substituted cyclopentadienes. Another preferred class of metallocenes are bridged and substituted indenes or fluorenes. One aspect of the processes described herein also includes treatment of the feed olefins to remove catalyst poisons, such as peroxides, oxygen, sulfur, nitrogen-containing organic compounds, and or acetylenic compounds. This treatment is believed to increase catalyst productivity, typically more than 5 fold, preferably more than 10 fold.

A preferred embodiment is a process to produce a polyalpha-olefin comprising:

1) contacting at least one alpha-olefin monomer having 3 to 30 carbon atoms with a metallocene compound and an activator under polymerization conditions wherein hydrogen, if present, is present at a partial pressure of 200 psi (1379 kPa) or less, based upon the total pressure of the reactor (preferably 150 psi (1034 kPa) or less, preferably 100 psi (690 kPa) or less, preferably 50 psi (345 kPa) or less, preferably 25 psi (173 kPa) or less, preferably 10 psi (69 kPa) or less (alternately the hydrogen, if present in the reactor at 30,000 ppm or less by weight, preferably 1,000 ppm or less preferably 750 ppm or less, preferably 500 ppm or less, preferably 250 ppm or less, preferably 100 ppm or less, preferably 50 ppm or less, preferably 25 ppm or less, preferably 10 ppm or less, preferably 5 ppm or less), and wherein the alpha-olefin monomer having 3 to 30 carbon atoms is present at 10 volume % or more based upon the total volume of the catalyst/activator/co-activator solutions, monomers, and any diluents or solvents present in the reaction; and 2) obtaining a polyalpha-olefin, optionally hydrogenating the PAO, and obtaining a PAO, comprising at least 50 mole % of a C3 to C30 alpha-olefin monomer, wherein the polyalpha-olefin has a kinematic viscosity at 100° C. of 5000 cSt or less, and the polyalpha-olefin comprises Z mole % or more of units represented by the formula:

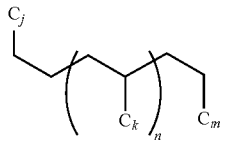

where j, k and m are each, independently, 1, 2, 3, 4, 5, 6, 7, 8, 9, 10, 11, 12, 13, 14, 15, 16, 17, 18, 19, 20, 21, or 22, n is an integer from 1 to 350, and An alternate embodiment is a process to produce a polyalpha-olefin comprising:

1) contacting a feed stream comprising one or at least one alpha-olefin monomer having 3 to 30 carbon atoms with a metallocene catalyst compound and a non-coordinating anion activator or alkylalumoxane activator, and optionally an alkyl-aluminum compound, under polymerization conditions wherein the alpha-olefin monomer having 3 to 30 carbon atoms is present at 10 volume % or more based upon the total volume of the catalyst/activator/co-activator solution, monomers, and any diluents or solvents present in the reactor and where the feed alpha-olefin, diluent or solvent stream comprises less than 300 ppm of heteroatom containing compounds; and obtaining a polyalpha-olefin comprising at least 50 mole % of a C5 to C24 alpha-olefin monomer where the polyalpha-olefin has a kinematic viscosity at 100° C. of 5000 cSt or less. Preferably, hydrogen, if present is present in the reactor at 30,000 ppm or less by weight, preferably 1,000 ppm or less preferably 750 ppm or less, preferably 500 ppm or less, preferably 250 ppm or less, preferably 100 ppm or less, preferably 50 ppm or less, preferably 25 ppm or less, preferably 10 ppm or less, preferably 5 ppm or less.

An alternate embodiment is a process to produce a polyalpha-olefin comprising:

1) contacting a feed stream comprising at least one alpha-olefin monomer having 3 to 30 carbon atoms with a metallocene catalyst compound and a non-coordinating anion activator or alkylalumoxane activator, and optionally an alkyl-aluminum compound, under polymerization conditions wherein the alpha-olefin monomer having 3 to 30 carbon atoms is present at 10 volume % or more based upon the total volume of the catalyst/activator/co-activator solution, monomers, and any diluents or solvents present in the reactor and where the feed alpha-olefin, diluent or solvent stream comprises less than 300 ppm of heteroatom containing compounds which; and obtaining a polyalpha-olefin comprising at least 50 mole % of a C5 to C24 alpha-olefin monomer where the polyalpha-olefin has a kinematic viscosity at 100° C. of 5000 cSt or less; Alternately, in this process described herein hydrogen, if present, is present in the reactor at 1000 ppm or less by weight, preferably 750 ppm or less, preferably 500 ppm or less, preferably 250 ppm or less, preferably 100 ppm or less, preferably 50 ppm or less, preferably 25 ppm or less, preferably 10 ppm or less, preferably 5 ppm or less.

2) isolating the lube fraction polymers and then contacting this lube fraction with hydrogen under typical hydrogenation conditions with hydrogenation catalyst to give fluid with bromine number below 1.8, or alternatively, isolating the lube fraction polymers and then contacting this lube fraction with hydrogen under more severe conditions with hydrogenation catalyst to give fluid with bromine number below 1.8 and with reduce mole % of mm components than the unhydrogenated polymers. The hydrogen pressure for this process is usually in the range from 50 psi to 3000 psi, preferably 200 to 2000 psi, preferably 500 to 1500 psi.

Molecular Weight Distribution (MWD)

In at least one embodiment, the molecular weight distribution is at least 10 percent less than equation 1. In a preferred embodiment the molecular weight distribution is less than equation 2 and in a most preferred embodiment the molecular weight distribution is less than equation 2 and more than equation 4.

Table 1 is a table demonstrating the differences between metallocene catalyzed PAO ("mPAO") and current high viscosity prior art PAO (cHVI-PAO). Examples 1 to 8 in the Table 1 were prepared from different feed olefins using metallocene catalysts. The metallocene catalyst system, products, process and feeds were described in Patent Applications Nos. PCT/US2006/021399 and PCT/US2006/021231. The mPAOs samples in Table 1 were made from C10, C6,12, C6 to C18, C6,10,14-LAOs. Examples 1 to 7 samples all have very narrow molecular weight distribution (MWD). The MWD of mPAO depends on fluid viscosity as shown in FIG. 1.

TABLE 1

| Example No. | 1 | 2 | 3 | 4 | 5 | 6 | 7 | 8 | 9 | 10 | 11 |
|---|---|---|---|---|---|---|---|---|---|---|---|
| sample type | mPAO | mPAO | mPAO | mPAO | mPAO | mPAO | mPAO | mPAO | cHVI-PAO | cHVI-PAO | cHVI-PAO |
| Feed LAO | C6/C12 | C6-C18 | C6-C18 | C10 | C6, 10, 14 | C6, 10, 14 | C10 | C10 | C10 | C10 | C10 |
| 100° C. Kv, cS | 150 | 151 | 540 | 671 | 460 | 794.35 | 1386.63 | 678.1 | 150 | 300 | 1,000 |
| 40° C. Kv, cS | 1701 | 1600 | 6642 | 6900 | 5640 | 10318 | 16362 | 6743 | 1500 | 3100 | 10,000 |
| VI | 199 | 207 | 257 | | 248 | 275 | 321 | 303 | 218 | 241 | 307 |
| Pour. ° C. | −33 | −36 | −21 | −18 | nd | nd | | −12 | −33 | −27 | −18 |
| MWD by GPC | | | | | | | | | | | |
| Mw | 7,409 | 8,089 | 17.227 | 19772 | 16149 | 20273 | 31769 | 29333 | 8.974 | 12,511 | 32,200 |
| MWD | 1.79 | 2.01 | 1.90 | 1.98 | 2.35 | 2.18 | 1.914 | 5.50 | 2.39 | 2.54 | 4.79 |
| % Visc Change by TRB Test (a) | | | | | | | | | | | |
| 20 hrs | −0.33 | −0.65 | −2.66 | −3.64 | −4.03 | −8.05 | −19.32 | −29.11 | −7.42 | −18.70 | −46.78 |
| 100 hrs | −0.83 | −0.70 | −1.07 | 1.79 | nd | nd | nd | nd | nd | −21.83 | −51.09 |

(a) CEC L-45-A-99 Taper Roller Bearing/C (20 hours) (KRL test 20 hours) at SouthWest Research Institute Molecular weight distribution is a function of viscosity. The higher the viscosity the higher the molecular weight distribution. FIG. 1 is a graph showing the molecular weight distribution as a function of viscosity at Kv 100° C. The circles represent the prior art prior art PAO. The squares and upper triangles represent the new metallocene catalyzed PAOs. Line 1 represents the preferred lower range of molecular weight distribution for the high viscosity metallocene catalyzed PAO. Line 3 represents preferred upper range of the molecular weight distribution for the high viscosity metallocene catalyzed PAO. Therefore, the region bounded by lines 1 and 3 represents the preferred molecular weight distribution region of the new metallocene catalyzed PAO. Line 2 represents the desirable and typical MWD of actual experimental samples of the metallocene PAO made from 1-decene. Line 5 represents molecular weight distribution of the prior art PAO.

Equation 1 represents the algorithm for line 5 or the average molecular weight distribution of the prior art PAO. Whereas equations 2, 3, and 4 represent lines 1, 3 and 2 respectively.

$$MWD=0.2223+1.0232*\log(Kv \text{ at } 100° \text{ C. in cSt}) \quad \text{Eq. 1}$$

$$MWD=0.41667+0.725*\log(Kv \text{ at } 100° \text{ C. in cSt}) \quad \text{Eq. 2}$$

$$MWD=0.8+0.3*\log(Kv \text{ at } 100° \text{ C. in cSt}) \quad \text{Eq. 3}$$

$$MWD=0.66017+0.44922*\log(Kv \text{ at } 100° \text{ C. in cSt}) \quad \text{Eq. 4}$$

When Example 1 to 7 samples were subjected to tapered roller bearing ("TRB") test, they show very low viscosity loss after 20 hours shearing or after extended 100 hours shearing (TRB). Generally, shear stability is a function of fluid viscosity. Lower viscosity fluids have minimal viscosity losses of less than 10%. When fluid viscosity is above 1000 cSt as in Example 7, the fluid loss is approximately 19% viscosity. Example 8 is a metallocene PAO with MWD of 5.5. This metallocene PAO shows significant amount of viscosity loss at 29%.

Examples 9, 10 and 11 are comparative examples. The high viscosity PAO are made according to methods described in U.S. Pat. Nos. 4,827,064 and 4,827,073. They have broad MWD and therefore poor shear stability in TRB test.

In embodiments, one or more of the aforementioned Group I to V base stocks may be blended with the HVI-PAO of the present invention, in the amount of 1% to 99 wt %, in embodiments from 1 to 90 wt %, or 50 to 99 wt %, or 55 to 90 wt %, or 1 to 50 wt %, or 1 to 45 wt %, or 5 to 50 wt %, or 5 to 45 wt %. Often, one or multiple of these other base stocks are chosen to blend with HVI-PAO to obtain the optimized viscometrics and the performance. Further, is preferred embodiments relate to the viscosity index of the base stocks usable as blending components in this invention, where in some instances the viscosity index is preferably 80 or greater, more preferably 100 or greater, and even more preferably 120 or greater. Additionally, in certain particular instances, viscosity index of these base stocks may be preferably 130 or greater, more preferably 135 or greater, and even more preferably 140 or greater.

In addition to these fluids described above, in a preferred embodiment a second class of fluids, selected to be different from the fluids discussed above, and preferably having a higher polarity is also added to the formulation. The polarity of a fluid may be determined by one of ordinary skill in the art, such as by aniline points as measured by ASTM D611 method. Usually fluids with higher polarity will have lower aniline points. Fluids with lower polarity will have higher aniline points. Most polar fluids will have aniline points of less than 100° C. In preferred embodiments, such fluids are selected from the API Group V base stocks. Examples of these Group V fluids include alkylbenzenes (such as those described in U.S. Pat. Nos. 6,429,345, 4,658,072), and alkylnaphthalenes (e.g., U.S. Pat. Nos. 4,604,491, and 5,602,086). Other alkylated aromatics are described in "Synthetic Lubricants and High Performance Functional Fluids", M. M Wu, Chapter 7, (L. R. Rudnick and R. L. Shubkin (ed.)), Marcel Dekker, N.Y. 1999.

In one embodiment, the use of low viscosity, high VI Group lit base oils including Visom 4 and/or GTL, as an alternate to the low viscosity PAO modal component, and the use of an alternate ester composition provides surprising performance. These formulations move away from completely synthetic base stocks, they demonstrate favorable gear energy efficiency performance.

Also included in this class and with very desirable lubricating characteristics are the alkylated aromatic compounds including the alkylated diphenyl compounds such as the alkylated diphenyl oxides, alkylated diphenyl sulfides and alkylated diphenyl methanes and the alkylated phenoxathins as well as the alkylthiophenes, alkyl benzofurans and the ethers of sulfur-containing aromatics. Lubricant blend components of this type are described, for example, in U.S. Pat. Nos. 5,552,071; 5,171,195; 5,395,538; 5,344,578; 5,371,248 and EP 815187.

Other Group V fluids that are suitable for use as blend components include polyalkylene glycols (PAGs), partially or fully ether- or ester end-capped PAGs. Ester base stocks may also used as co-base stocks in formulations according to the invention. These esters can be prepared, for instance, by dehydration of mono-acids, di-acids, tri-acids with alcohols with mono-, di- or multi-alcohols. Preferred acids include C5-C30 monobasic acids, more preferably 2-ethylhexanoic acid, isoheptyl, isopentyl, and capric acids, and di-basic acids, more preferably adipic, fumaric, sebacic, azelaic, maleic, phthalic, and terephthalic acids. The alcohols can be any of the suitable mono-alcohols or polyols. Preferred examples are 2-ethylhexanol, iso-tridecanols, neopentyl glycol, trimethylol ethane, 2-methyl-2-propyl-1,3-propanediol, trimethylol propane, pentaerythritol, and dipentaerythritol. Preparation, properties and use of these alcohols are summarized in Chapter 3 of Rudnick et al., supra.

The present inventors have found that using these secondary Group V base stocks usually improve one or several of the finished lubricant product properties, such as the viscosity, solvency, seal swell, clarity, lubricity, oxidative stability, and the like, of the finished lubricant products.

The viscosity grade of the final product is adjusted by suitable blending of base stock components of differing viscosities. In many conventional lubricant formulations, thickeners are used to increase viscosity. One particular advantage of the present invention is that thickeners are not necessary and in preferred embodiments no thickeners are used. HVI-PAO fluids of different viscosity grades are most suitably used to achieve wide finished viscosity grades with significant performance advantages. Usually, differing amounts of the various basestock components (primary hydrocarbon base stocks, secondary base stock and any additional base stock components) of different viscosities, may be suitably blended together to obtain a base stock blend with a viscosity appropriate for blending with the other components (such as described below) of the finished lubricant. This may be determined by one of ordinary skill in the art in possession of the present disclosure without undue experimentation. The viscosity grades for the final product are preferably in the range of ISO 2 to ISO 1000 or even higher for gear lubricant applications, for example, up to about ISO 46,000. For the lower viscosity grades, typically from ISO 2 to ISO 100, the viscosity of the combined base stocks will be slightly higher than that of the finished product, typically from ISO 2 to about ISO 220 but in the more viscous grades up to ISO 46,000, the additives will frequently decrease the viscosity of the base stock blend to a slightly lower value. With a ISO 680 grade lubricant, for example, the base stock blend might be about 780-800 cSt (at 40° C.) depending on the nature and content of the additives.

In conventional formulations, the viscosity of the final product may be brought to the desired grade by the use of polymeric thickeners especially in the product with the more viscous grades. Typical thickeners which may be used include the polyisobutylenes, as well as ethylene-propylene polymers, polymethacrylates and various diene block polymers and copolymers, polyolefins and polyalkylstyrenes. These thickeners are commonly used as viscosity index improvers (VIIs) or viscosity index modifiers (VIMs) so that members of this class conventionally confer a useful effect on the temperature-viscosity relationship. Although optionally used in formulations according to the present invention, such components may be blended according commercial market requirement, equipment builder specifications to produce products of the final desired viscosity grade. Typical commercially available viscosity index improvers are polyisobutylenes, polymerized and co-polymerized alkyl methacrylates, and mixed esters of styrene maleic anhydride interpolymers reacted with nitrogen containing compounds.

The polyisobutenes, normally with a number average or weight average molecular weight from 10,000 to 15,000, are a commercially important class of VI improvers and generally confer strong viscosity increases as a result of their molecular structure. The diene polymers which are normally copolymers of 1,3-dienes such as butadiene or isoprene, either alone or copolymerized with styrene are also an important class commercially, with typical members of this class sold under names such as Shelivis™. The statistical polymers are usually produced from butadiene and styrene while the block copolymers are normally derived from butadiene/isoprene and isoprene/styrene combinations. These polymers are normally subjected to hydrogenation to remove residual diene unsaturation and to improve stability. The polymethacrylates, normally with number average or weight average molecular weights from 15,000 to 25,000, represent another commercially important class of thickeners and are widely commercially available under designations such as Acryloid™.

One class of polymeric thickeners is the block copolymers produced by the anionic polymerization of unsaturated monomers including styrene, butadiene, and isoprene. Copolymers of this type are described, for instance, in U.S. Pat. Nos. 5,187,236; 5,268,427; 5,276,100; 5,292,820; 5,352,743; 5,359,009; 5,376,722 and 5,399,629. Block copolymers may be linear or star type copolymers and for the present purposes, the linear block polymers are preferred. The preferred polymers are the isoprene-butadiene and isoprene-styrene anionic diblock and triblock copolymers. Particularly preferred high molecular weight polymeric components are the ones sold under the designation Shelivis™ 40, Shelivis™ 50 and Shelivis™ 90 by Infenium Chemical Company, which are linear anionic copolymers. Of these, Shelivis™ 50 is an anionic diblock copolymer and Shelivis™ 200, Shelivis™ 260 and Shelivis™ 300 are star copolymers.

Some thickeners may be classified as dispersant-viscosity index modifiers because of their dual function, as described in U.S. Pat. No. 4,594,378. The dispersant-viscosity index modifiers disclosed in the '378 patent are the nitrogen-containing esters of carboxylic-containing interpolymers and the oil-soluble acrylate-polymerization products of acrylate esters, alone or in combination. Commercially available dispersant-viscosity index modifiers are sold under trade names Acryloid™ 1263 and 1265 by Rohm and Haas, Viscoplex™ 5151 and 5089 by Rohm-GMBHO™ Registered ™ and Lubrizol™ 3702 and 3715.

Antioxidants, although optional, may be used to improve the oxidative stability of formulations according to the present invention. A wide range of commercially available materials is suitable. The most common types of antioxidant which may be used in the present compositions are the phenolic antioxidants, the amine type antioxidants, the alkyl aromatic sulfides, phosphorus compounds such as the phosphites and phosphonic acid esters and the sulfur-phosphorus compounds such as the dithiophosphates and other types such as the dialkyl dithiocarbamates, e.g. methylene bis(di-n-butyl) dithiocarbamate. They may be used individually by type or in combination with one another. Mixtures of different types of phenols or amines are particularly preferred.

The preferred sulfur compounds which are optionally added to compositions according to the present invention for improved antioxidant performance include the dialkyl sulfides such as dibenzyl sulfide, polysulfides, diaryl sulfides, modified thiols, mercaptobenzimidazoles, thiophene derivatives, xanthogenates, and thioglycols.

Phenolic antioxidants which may be used in the present lubricants may suitably be ashless (metal-free) phenolic compounds or neutral or basic metal salts of certain phenolic compounds. The amount of phenolic compound incorporated into the lubricant fluid may vary over a wide range depending upon the particular utility for which the phenolic compound is added. In general, from about 0.1 to about 10% by weight of the phenolic compound will be included in the formulation. More often, the amount is from about 0.1 to about 5%, or about 1 wt % to about 2 wt %. Percentages used herein are based on the total formulation unless otherwise specified.

The preferred phenolic compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with C6 alkyl groups and the alkylene coupled derivatives of these hindered phenols. Examples of phenolic materials of this type is 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6di-t-butyl-4-heptyl phenol; and 2-methyl-6-di-t-butyl-4-dodecyl phenol. Examples of ortho coupled phenols include: 2,2'-bis(6t-butyl-4-heptyl phenol); 2,2'-bis(6-t-butyl-4-octyl phenol); and 2,2'-bis(6-t-butyl4-dodecyl phenol). Sulfur containing phenolics can also be used to great advantage. The sulfur can be present as either aromatic or aliphatic sulfur within the phenolic antioxidant molecule.

Non-phenolic oxidation inhibitors, especially the aromatic amine antioxidants may also be used either as such or in combination with the phenolics. Typical examples of non-phenolic antioxidants include: alkylated and non-alkylated aromatic amines such as the aromatic monoamines of the formula $R^3R^4R^5N$ where $R^3$ is an aliphatic, aromatic or substituted aromatic group, $R^4$ is an aromatic or a substituted aromatic group, and $R^5$ is H, alkyl, aryl or $R^6S(O)xR^7$ where $R^6$ is an alkylene, alkenylene, or aralkylene group, $R^7$ is a higher alkyl group, or an alkenyl, aryl, or alkaryl group, and x is 0, 1 or 2. The aliphatic group $R^3$ may contain from 1 to about 20 carbon atoms, and preferably contains from 6 to 12 carbon atoms. The aliphatic group is a saturated aliphatic group. Preferably, both $R^3$ and $R^4$ are aromatic or substituted aromatic groups, and the aromatic group may be a fused ring aromatic group such as naphthyl. Aromatic groups $R^3$ and $R^4$ may be joined together with other groups such as S.

Typical aromatic amines antioxidants have alkyl or aryl substituent groups of at least 6 carbon atoms. Examples of aliphatic groups include hexyl, heptyl, octyl, nonyl, and decyl. Examples of aryl groups include styrenated or substituted-styrenated groups. Generally, the aliphatic groups will not contain more than 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyidiphenylamine; octylphenyl-beta-naphthylamine; t-octylphenyl-alpha-naphthylamine; phenyl-alphanaphthylamine; phenyl-beta-naphthylamine; p-octyl phenyl-alpha-naphthylamine; 4-octylphenyl-l-octyl-beta-naphthylamine.

Typical of the dialkyl dithiophosphate salts which may be used are the zinc dialkyl dithiophosphates, especially the zinc dioctyl and zinc dibenzyl dithiophosphates. These salts are often used as anti-wear agents but they have also been shown to possess antioxidant functionality, especially when used as a co-antioxidant in combination with an oil-soluble copper salt. Copper salts which may be used in this way as antioxidants in combination with the phosphorus and zinc compounds such as zinc dialkyl dithiophosphates include the copper salts of carboxylic adds such as stearic add, palmitic acid and oleic acid, copper phenates, copper sulfonates, copper acetylacetonates, copper naphthenates from naphthenic acids typically having a number average or weight average molecular weight of 200 to 500 and the copper dithiocarbamates and copper dialkyl dithiophosphates where the copper has been substituted for zinc. Copper salts of this type and their use as antioxidants are described in U.S. Pat. No. 4,867,890.

Normally, the total amount of antioxidant will not exceed 10 wt. % of the total composition and normally is rather less, below 5 wt. %. Usually, from 0.5 to 2 wt. % antioxidant is suitable although for certain applications more may be used if desired.

Inhibitor Package

An inhibitor package is used to provide the desired balance of anti-wear and anti-rust/anti-corrosion properties. One component of this package is a substituted benzotriazole-lamine phosphate adduct and the other is a tri-substituted phosphate, especially a triaryl phosphate such as cresyl diphenylphosphate, a known material which is commercially available. This component is typically present in minor amounts up to 5 wt. % of the composition. Normally less than 3% e.g. from 0.5 to 2 wt. % of the total composition is adequate to provide the desired anti-wear performance.

The second component of the anti-wear/anti-rust package is an adduct of benzotriazole or a substituted benzotriazole with an amine phosphate adduct which also provides anti-wear and anti oxidation performance. Certain multifunctional adducts of this kind (with aromatic amines) are described in U.S. Pat. No. 4,511,481 to which reference is made for a description of these adducts together with the method by which they may be prepared. Briefly, these adducts comprise a substituted benzotriazole. i.e. an alkyl-substituted benzotriazole where the substituent R is hydrogen or lower alkyl, $C_1$ to $C_6$, preferably $CH_3$. The preferred triazole is tolyl triazole (TTZ). For convenience, this component will be referred to as TTZ here although other benzotriazoles may also be used, as described in U.S. Pat. No. 4,511,481.

The amine component of the adduct may be an aromatic amine phosphate salt of the formula set out in U.S. Pat. No. 4,511,481, i.e., a triazole adduct of an amine phosphate. Alternatively, the main component may be an aliphatic amine salt, for example, a salt of an organoacid phosphate and an alkylamine such as a dialkylamine. The alkyl amine phosphate adducts may be made in the same way as the aromatic amine adducts. A preferred salt of this kind is the mono-/di-hexyl acid phosphate salt of long chain ($C_{11}$-$C_{14}$) alkylamines which can be made into an adduct with TTZ in this way for use in the present compositions. The adduct can range from 1:3 to 3:1 (mole) with the preferred adduct having a 75:25 ratio (weight) of the TTZ and the long chain alky/organoacid phosphate salt.

The TTZ amine phosphate salt adduct is typically used in relatively small amounts below about 5 wt. % and normally from about 0.1 to 1 wt. %, e.g. about 0.25 wt. %, is adequate when used in combination with the trihydrocarbyl phosphate, e.g. cresyl diphenylphosphate, component in order to give a good balance of anti-wear and anti-rust properties. Normally the CDP and the TTZ adduct are used in a weight ratio from 2:1 to 5:1.

Additional anti-rust additives may also be used. Metal deactivators which are commercially available and useful for this purpose, include, for example, the N,N-disubstituted aminomethyl-1,2,4-triazoles, and the N,N-disubstituted amino methyl-benzotriazoles. The N,N-disubstituted aminomethyl-1,2,4-triazoles can be prepared by a known method, namely be reacting a 1,2,4-triazole with formaldehyde and an amine, as described in U.S. Pat. No. 4,734,209. The N,N-disubstituted aminomethyl-benzotriazole can be similarly obtained by reacting a benzotriazole with formaldehyde and an amine, as described in U.S. Pat. No. 4,701,273. Preferably, the metal deactivator is 1-[bis(2-ethylhexyl)aminomethyl]-1,2,4-triazole or 1-[bis(2-ethylhexyl)aminomethyl]-4-methylbenzotriazole (adduct of tolyltriazole:formaldehyde:di-2-ethylhexylamine (1:1:1 m)), which are commercially available. Other rust inhibitors which may be used to confer additional rust protection include the succinimde derivatives such as the higher alkyl substituted amides of dodecylene succinic acid, which are also commercially, the higher alkyl substituted amides of dodecenyl succinic acid such as the tetrapropenylsuccinic monoesters (commercially available) and imidazoline succinic anhydride derivatives, e.g. the imidazoline derivatives of tetrapropenyl succinic anhydride. Normally, these additional rust inhibitors will be used in relatively small amounts below 2 wt. % although for certain applications e.g. in paper-making machinery oils, amounts up to about 5 wt. % may be employed if necessary.

The oils may also include other conventional additives, according to particular service requirements, for example dispersants, detergents, friction modifiers, traction improving additives, demulsifiers, defoamants, chromophores (dyes), haze inhibitors, according to application, all of which may be blended according to conventional methods using commercially available materials.

As noted above, the present lubricating oils have superior properties and performance features. Examples of the good properties include excellent to viscometrics, high VI, low pour point, superior low temperature viscosities, thermal oxidative stability, etc. These properties can be measured by many standard or special test. Usually, the kinematic viscosity were measured by ASTM D445. VI can be calculated by ASTM D2270. Pour point of a lubricant can be measured by ASTM D97 method. Cloud point of lubricant can be measured by ASTM D2500 method. Saybolt Universal Viscosity can be calculated by ASTM D2161 method. Low temperature, low-shear-rate viscosity of many gear oils, transmission oils, industrial lubricants and engine oils can be measured by Brookfield viscometer according to the ASTM D2983 method. Alternatively, when a range of viscosities at low temperatures are required, a scanning Brookfield viscosity can be obtained according to ASTM D5133 method. Viscosity at high temperature high shear rate can be measured by D4624, D5481, or D4741 method.

Good antiwear characteristics are indicated by performance in the FZG Scuffing test (DIN 51534), with fail stage values of at least 8, more usually in the range of 9 to 13 or even higher. The FZG test is indicative of performance for steel-on-steel contact as encountered in normal gear sets; good performance in this test indicates that good spur gear performance can be expected. The higher FZG test values are typically achieved with the higher viscosity grade oils, e.g. ISO 100 and higher will have an FZG value of 12 or higher, even 13 or higher, in comparison with values of 9 to 12 for grades below ISO 100. Values of 13 or higher (A/16.6/90) or 12 and higher (A/8.3/140) may be achieved with ISO grades of 300 and higher.

The anti-wear performance may also be indicated by a 4-Ball (ASTM D 4172) wear test value of not more than 0.35 mm maximum scar diameter (steel on steel, 1 hr, 180 rpm, 54° C., 20 Kg/cm$^2$) with values of not more than 0.30 mm being readily attainable. 4-ball EP Weld values of 120 or higher, typically 150 or higher may be achieved. ASTM 4-Ball steel-on-bronze values of 0.07 mm (wear scar diameter) are typical.

The superior shear stability of the oils described in this invention can also be measured by many shear stability tests. Examples are Kurt Orbahn diesel injector test (ASTM 3945) or ASTM D5275 method. Another test for the shear stability is the tapered roller bearing shear test (CEC L-45-T/C method). It can also be measured by a sonic shear stability test (ASTM D2603 method). Shear stability is important for many industrial oil operations. Higher shear stability means the oil does not lose its viscosity at high shear. Such shear-stable oil can offer better protection under more severe operation conditions. The oil compositions described in this invention have superior shear stability for industrial oil applications.

The tendency of lubricating oils to foam can be a serious problem in systems such as gearing, high volume pumping, circulating lubrication and splash lubrication, etc. Foam formation in lubricant oils may cause inadequate lubrication, cavitation and overflow loss of lubricant, leading to mechanical failure. Therefore, it is important to control the foam property of a lubricant oil. This is especially important for industrial lubricants. Many methods were developed to measure the foaming tendency of lubricant.

Energy efficiency is becoming a more important factor in modern machinery. Equipment builders are looking for ways to improve the equipment's energy efficiency, reduce power consumption, reduce friction loss, etc. For example, refrigerator builders, consumers and government agencies are demanding energy efficient compressors for refrigeration units. Government mandates minimum energy efficiency for automobiles. Gear operators are demanding more efficient gears with lower energy consumption, lower operating temperature, etc. A lubricant can affect the energy efficiency of a machinery system in many ways. For example, lower viscosity lubricants with specified protection level will have lower viscous drag, thus less energy loss and better efficiency. Lubricants with lower frictional coefficients usually have better energy efficiency. Lubricants that produce excessive foaming reduce the volumetric efficiency. For example, on the downstroke of the piston, the foamy layer is compacted. This compaction absorbs energy and thus reduces the energy available for useful work. The lubricants disclosed in this invention have many of these energy efficient characteristics.

Energy efficiency of industrial oil is best tested under operating conditions. Such comparisons can be meaningfully made by using side-by-side comparison. Examples of such results are reported in a paper "Development and Performance Advantages of Industrial, Automotive and Aviation Synthetic Lubricants" Journal of Synthetic Lubrication, [1] p. 6-33 by D. A. Law and J. R. Lohuis, J. Y Breau, A. J. Harlow and M. Rochette.

Applications

The lubricant or grease components disclosed in this invention are most suitable for applications in where one of more the following characteristics are desirable: wide temperature range, stable and reliable operation, superior protection, extended operation period, energy efficient. The present oils are characterized by an excellent balance of performance properties including superior high and low temperature viscosities, flowability, excellent foam property, shear stability, and improved anti-wear characteristics, thermal and oxidative stability, low friction, low traction. They may find utility as gear oils, bearing oil, circulating oils, compressor oils, hydraulic oils, turbine oils, grease for all kinds of machinery, as well as in other applications, for example, in wet clutch systems, blower bearings, wind turbine gear box, coal pulverizer drives, cooling tower gearboxes, kiln drives, paper machine drives and rotary screw compressors.

EXPERIMENTAL

The following examples are meant to illustrate the present invention and provide a comparison with other methods and the products produced there from. Numerous modifications and variations are possible and it is to be understood that within the scope of the appended claims, the invention may be practiced otherwise than as specifically described herein.

I. HVI-PAOs from Non-metallocene Catalysts

Preparation of the HVI-PAOs set forth in Table 2 below was described in U.S. Pat. No. 4,827,064. In this process, fluids with 100° C. viscosity ranging from 5 to 3000 cSt were prepared in high yields. Three representative examples of these fluids used for product formulation were summarized in Table 1, below.

TABLE 2

Properties of HVI-PAO

| | Sample 1 | Sample 2 | Sample 3 |
|---|---|---|---|
| 100° C. vis, cSt | 18.5 | 145 | 298 |
| VI | 165 | 214 | 246 |
| Pour Point, ° C. | −55 | −40 | −32 |

II. HVI-PAO by Metallocene Catalysts.

Sample 4. To a 500 ml flask, charge toluene (20 grams), 1,3-dimethylcyclopentadienyl zirconium dichloride (0.01 gram) and 10% MAO in toluene solution (20.1 grams) under inert atmosphere. Add 1-decene (100 gram) slowly into the catalyst mixture from addition funnel while maintaining reaction temperature at 20-25° C. Let reaction mixture stir for 16 hours. Quench catalyst with 3 ml water and basic alumina. Filter to remove solids. Distill the liquid at 140° C./<1 millitorr to remove any C20 and lighter components to provide lube sample. The lube yield is 92 wt. %. The lube has the following properties: 100° C. Visc=312 cSt, 40° C. visc=3259 cSt and VI=250. This lube was further hydrogenated at standard typical hydrogenation conditions to give finished product.

Sample 5. This sample was prepared in a similar manner as Sample 4, except dimethysilyl bis[cyclopentadienyl] zirconium dichloride was used as to catalyst. The lube product has the following properties: 100° C. Visc=8.96 cSt, 40° C. visc=49.32 cSt and VI=164. The lube after hydrogenation under standard conditions can be used in industrial lube formulation.

TABLE 3

Lube properties of synthetic automotive gear oils

| Example | 17 | 18 | 19 | 20 |
|---|---|---|---|---|
| Vis grade | 75W-90 | 75W-90 | 75W-140 | 75W-140 |
| Wt % HVI-PAO | 53.4 | 0 | 60 | 0 |
| Wt % conventional PAO | 0 | 54.2 | 0 | 60 |
| Wt % other base stock | 36.3 | 36.3 | 30 | 30 |
| Wt % additives | 9.3 | 9.3 | 10 | 10 |
| Visc at 100° C., cSt | 15.7 | 15.7 | 24.8 | 26.3 |
| VI | 174 | 151 | 203 | 174 |
| Pour point, ° C. | <−65 | −55 | <−65 | −55 |
| Brookfield viscosity @ −40° C., cP | 61,500 | 116,600 | 54,000 | 147,600 |

In order to evaluate the shear stability of m-SuperSyn, measurements were conducted using the KRL Bearing Shear Test (CEC L-45-A-99). This industry test, in the presence of the test lubricant, uses a tapered roller bearing run at 60° C. for 20 hours. Kinematic viscosity measurements at 100° C. are performed on the candidate fluid prior to the 20 hr run and immediately after. The difference in kinematic viscosity is an indicator of the permanent shear undergone by the test fluid. This difference is reported as a % viscosity loss. Typical finished gear lubricants exhibit up to 5% loss in fluid viscosity after this test. Two candidate fluid were submitted for this testing in order to demonstrate the enhanced shear stability of m-SuperSyn. In addition, to further demonstrate the enhanced shear stability, this testing was performed at triple-length (60 hrs).

The test fluids were identical in composition with the exception of the catalyst used to produce the 150 cSt Super-Syn component (chrome-silica derived vs. metallocene derived). Table 4 shows the basic formulations of the two test fluids labeled formulation 1 and 2.

TABLE 4

| Formulation | 1 | 2 |
|---|---|---|
| cPAO 150 cSt | 38.74 | |
| mPAO 150 cSt | | 38.74 |
| cPAO 2 cSt | 28.00 | 28.00 |
| di-octyl sebacate | 20.00 | 20.00 |
| Defoamant | 0.10 | 0.10 |
| Gear Oil Package A | 13.16 | 13.16 |
| Total(%) | 100 | 100 |

Table 5 shows the shear stability properties of formulation 1 versus formulation 2. Formulation 2 with the mPAO has favorable shear stability properties compared to formulation 1 with cPAO.

TABLE 5

| Formulation | 1 | 2 |
|---|---|---|
| Kinematic Viscosity, 40° C. | 62.84 | 63.29 |
| Kinematic Viscosity, 100° C. | 12.87 | 12.36 |
| Viscosity Index | 210 | 198 |
| Density @ 60° F. | 0.8627 | 0.8618 |
| Brookfield Viscosity, −40° C. | 12768 | 14460 |
| Brookfield Viscosity, −55° C. | 252200 | 130200 |
| KRL Shear (bearing, 20 hr) | 9.3 | 1.1 |
| KRL Shear (bearing, 100 hr) | | 1.7 |
| Add. Metals in Lubes, XRF | <0.0020 | <0.0020 |
| Add. Metals in Lubes, XRF | 2.19 | 2.27 |
| Add. Metals in Lubes, XRF | 0.1412 | 0.1433 |
| Add. Metals in Lubes, XRF | <0.0020 | <0.0020 |
| Add. Metals in Lubes, XRF | 0.0091 | 0.0094 |
| Add. Metals in Lubes, XRF | <0.0020 | <0.0020 |
| Add. Metals in Lubes, XRF | <0.0020 | <0.0020 |
| Flash Point | 176 | 176 (est) |
| Volatility, @ 200° C. | 19.3 | 19.6 |
| TAN | 4.08 | |

Figure 2:
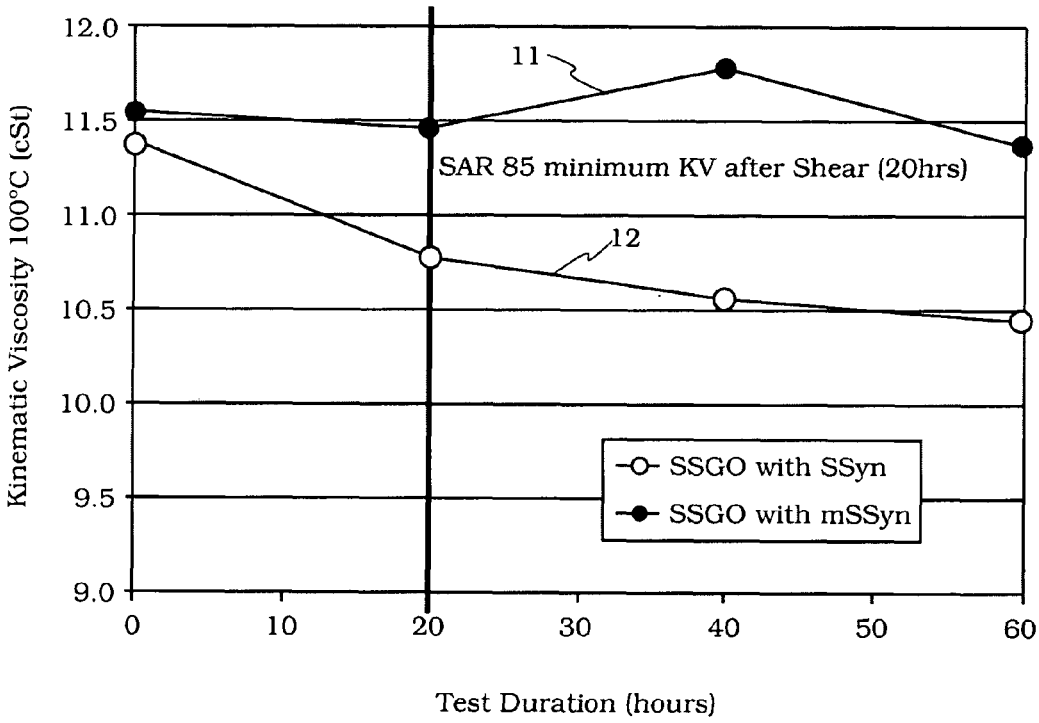
FIG. 2 is a graph illustrating the improved Kinematic Viscosity of a gear oil shear formulation using metallocene-catalyst derived PAOs compared with chromium-catalyst derived PAOs.

FIG. 2 displays the shear testing properties of a formulation with metallocene catalyzed PAO compared to a chrome-silica catalyzed PAO formulation. The metallocene catalyzed PAO 11 clearly has favorable shear stability compared to the chrome-silica catalyzed PAO 12 throughout the entire test.

This unexpected benefit in shear stability shown in FIG. 1 is exemplified by stable viscometrics up to triple the normal testing time which greatly increases test severity. Based on this unexpected result for gear lubricants using m-SuperSyn, There are many additional benefits that are expected. These benefits include: enhanced film thicknesses under shearing conditions similar to loaded gear and bearing contacts; enhanced post-sheared volatility of the gear lubricant (e.g. low introduction of low viscosity sheared components); with the reduced shear, less free-radical components due to base oil shearing are created. This therefore consumes less anti-oxidants (AO) in the finished gear lubricant and allows more AO to be available for use in other free-radical processes typical in the lubricant aging process; finished fluid viscosity retention in the absence of traditional polymeric viscosity improvers; improved longevity of gear parts (less frequent maintenance) due to viscosity retention.

III. Benefits of Ester with HVI PAO

In one embodiment, the formulation space covers the use of high VI Group III base oils for example, Visom 4, grades of high VI PAO from 150 cSt to 600 cSt, and two different ester compositions, either isononyl heptanoate ester or dioctyl sebacate ester. In this embodiment, very high VI (200+) base oil combinations can be produced. These combinations of Visom 4 esters may provide lower cost alternatives to compositions using PAO as the low viscosity component.

Table 6 shows various formulations. Formulations A, B, C and D) are base stock combinations. Formulations E, F, and G are fully formulated lubricant demonstrating 3 different preferred inventive embodiments. Formulations H and I show fully formulated lubricants without di-octyl sebacate for comparison.

TABLE 6

| Components | A | B | C | D | E | F | G | H | I |
|---|---|---|---|---|---|---|---|---|---|
| Gear Oil Package A | | | | | 13.16 | 13.16 | 13.16 | 13.31 | |
| Gear Oil Package B | | | | | | | | | 9 |
| mPAO 150 cSt | 49.00 | 48.00 | 47.00 | 47.00 | 38.74 | 40.24 | 37.24 | 43.49 | 44 |
| cPAO 2 cSt | 46.00 | 42.00 | 38.00 | 33.00 | 27.00 | 36.50 | 19.50 | 23.10 | 25.90 |
| cPAO 4 cSt | | | | | | | | | |
| Monoester | | | | | | | | 20.00 | 20.00 |
| di-octyl sebacate | 5.00 | 10.00 | 15.00 | 20.00 | 20.00 | 10.00 | 30.00 | | |
| Antioxidant | | | | | | | | | 1.0 |
| Defoamant | | | | | 0.10 | 0.10 | 0.10 | 0.10 | 0.10 |
| Total (%) | 100.00 | 100.00 | 100.00 | 100.00 | 100.00 | 100.00 | 100.00 | 100.00 | 100.00 |

Table 7 below shows the properties of all the formulations in table 5. As shown in Table 7, the inventive formulations E, F, and G provides improved properties. Formulations H and I show fully formulated inventive embodiments for comparison.

TABLE 7

| Components | A | B | C | D | E | F | G | H | I |
|---|---|---|---|---|---|---|---|---|---|
| Kinematic Viscosity, ASTM D445, KV 100 C. | 12.85 | 12.77 | 12.68 | 13.15 | 12.83 | 12.14 | 12.43 | 12.14 | 11.35 |
| Kinematic Viscosity, ASTM D445, KV 40 C. | 60.66 | 60.04 | 59.36 | 62.11 | 62.76 | 58.77 | 60.45 | 55.74 | 50.45 |
| VI (calc) | 218 | 218 | 219 | 219 | 210 | 209 | 209 | 222 | 227 |
| Density, D4052-1, 60° F. | 0.8280 | 0.8330 | 0.8381 | 0.8438 | 0.8629 | 0.8514 | 0.874 | 0.8563 | 0.8504 |
| Brookfield Viscosity, ASTM D2983-7, cP, −40 C. | 8780 | 8640 | 8760 | 9360 | 12768 | 10560 | 13180 | | 6320 |
| Brookfield Viscosity, ASTM D2983-17, cP, −55 C. | | | | | 208400 | 314000 | 353000 | | 61787 |
| Noack Volatility, ASTM D5800, 200 C., % lost | 21.5 | 19.8 | 18.4 | 15.8 | 20 | | | 34.3 | 34.3 |
| Noack Volatility, ASTM D5800, 150 C., % lost | 2.8 | 2.8 | 2.5 | 2.3 | 3.5 | | | 6.7 | 15.6 |
| Flash Point, COC, ASTM D92 | | | | | 176 | | | | 160 |
| Flash Point, PMCC, ASTM D93 | | | | | 156 | | | | 135.5 |
| DKA Oxidation (192 hr), 160 C. (500 ml), CEC L-48-A-00, % KV100 Visc Increase | | | | | 85.3 | 174.63 | 145.16 | 104.6 | |
| L-33-1 Gear Moisture/ Corrosion, ASTM D7038 | | | | | | PASS | | FAIL | PASS |

In a preferred embodiment, we have discovered an unexpected synergistic benefit of using di-octyl sebacate ester in the inventive blends. In particular, we have discovered the favorable treat range of di-octyl sebacate ester of preferably greater than 10 weight percent of the finished formulation, more preferably greater than 10 weight percent and less than 30 weight percent and most preferably at least 15 weight percent and less than 25 weight percent. Even more preferably the ester has a viscosity greater than 3 and less than 6 cSt kv 100° C.

Figure 3:
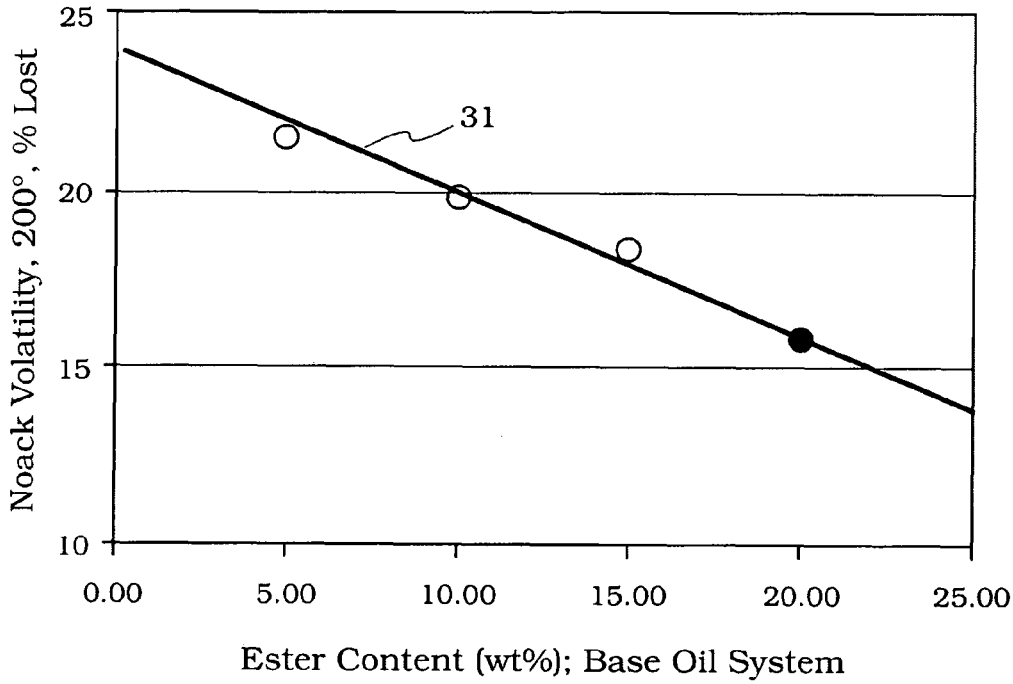
FIG. 3 is a graph illustrating Noack volatility losses based on ester content.

FIG. 3 is a graph illustrating Noack volatility losses based on ester content from formulations A, B, C, and D in tables 6 and 7. As can be seen in this figure Noack volatility improves as the ester content is increased—31.

Figure 4:
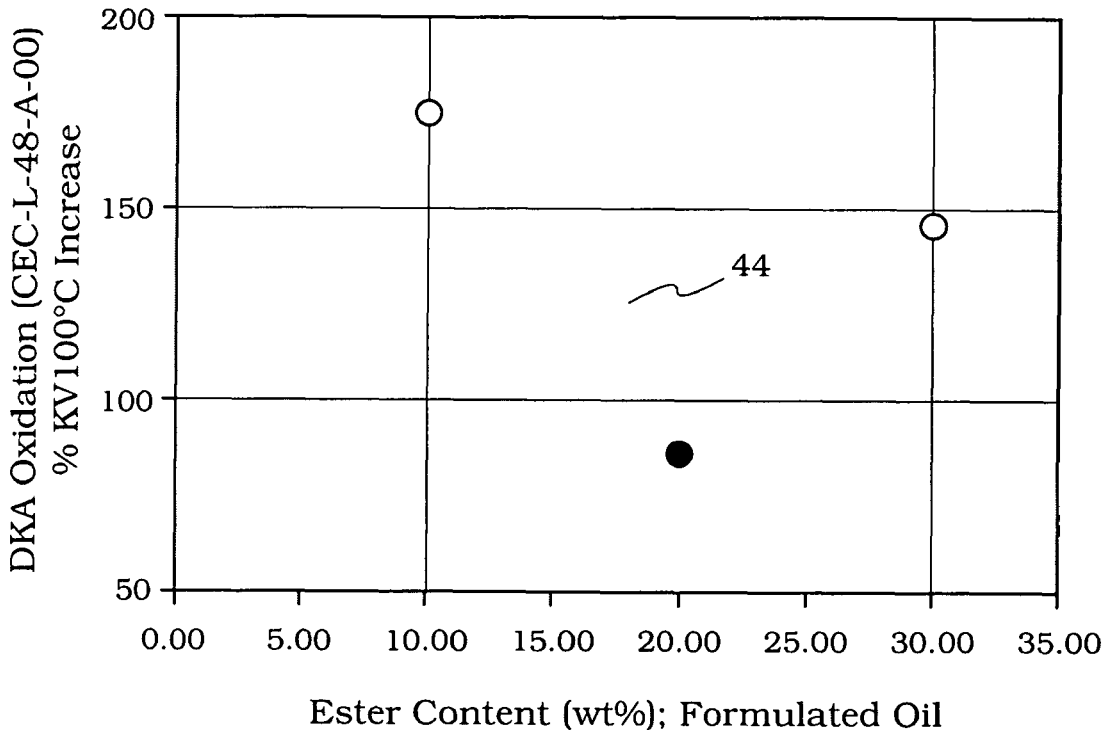
FIG. 4 is a graph illustrating oxidation performance based on ester content.

FIG. 4 is a graph illustrating oxidation performance based on ester content from formulations E, F, and G in tables 6 and 7. As can be seen in this figure, favorable oxidation is between 10 weight percent and 30 weight percent ester with a preferred of 20 weight percent—41.

Figure 5:
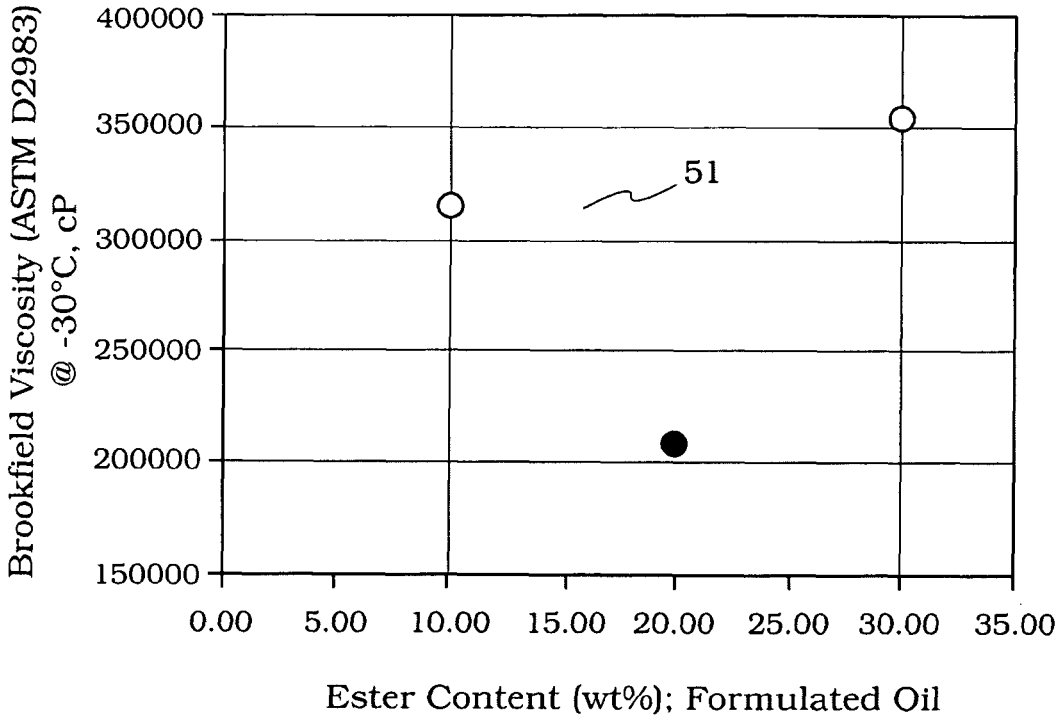
FIG. 5 is a graph illustrating Brookfield viscosity based on ester content.

FIG. 5 is a graph illustrating Brookfield viscosity based OR ester content comparing formulation E with H and I in tables 6 and 7. As can be seen in this figure, favorable oxidation is between 10 weight percent and 30 weight percent ester with a preferred of 20 weight percent—51.

The examples above demonstrated that HVI-PAO can be used broadly in many oil and greases with performance advantages over conventional lube compositions.

Trade names used herein are indicated by a ™ symbol or ® symbol, indicating that the names may be protected by certain trademark rights, e.g., they may be registered trademarks in various jurisdictions.

All patents and patent applications, test procedures (such as ASTM methods, UL methods, and the like), and other documents cited herein are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The invention has been described above with reference to numerous embodiments and specific examples. Many variations will suggest themselves to those skilled in this art in light of the above detailed description. All such obvious variations are within the full intended scope of the appended claims.

What is claimed is:

1. An oil formulation comprising:

a) a metallocene catalyzed HVI-PAO with a viscosity greater than 125 cStkv 100° C. and a viscosity index greater than 100;

b) a second base stock with a viscosity of at least 2 cStkv 100° C. and less than 60cStkv 100° C. wherein the second base stock is at least 60 cStkv 100° C. less than the metallocene HVI-PAO;

c) a di-octylsebacate ester with a viscosity of at least 2 and less than 6 cStkv 100° C., the ester comprising more than 10 weight percent and less than 30 weight percent of the oil formulation;

d) the oil formulation having a viscosity index of greater than 195, wherein the shear stability of the oil formulation as measured by % viscosity loss at 100° C. using the KRL Bearing Shear Test (CEC L-45-A-99) is less than or equal to 1.7%.

2. The oil formulation according to claim 1, wherein the metallocene HVI-PAO has a viscosity greater than 150 cStkv 100° C.

3. The oil formulation according to claim 1 further comprising a polar Group V base stock.

4. The oil formulation according to claim 1, wherein the second base stock is a PAO.

5. The oil formulation according to claim 1 wherein the second base stock is a Group III base stock.

6. The oil formulation according to claim 1 wherein the second base stock is a GTL base stock.

7. The oil formulation according to claim 1, wherein the oil formulation has a Noack volatility ASTM D5800 of 200° C. loss of 20% and less.

8. The oil formulation according to claim 1, wherein the oil formulation has no olefin co-polymers ("OCP") and no polyiso butylene ("PIB") viscosity modifiers.

9. The oil formulation according to claim 1, wherein the oil formulation has no viscosity modifiers.

10. The oil formulation according to claim 1, wherein said HVI-PAO is characterized by a viscosity index (VI) greater than 160, as measured by ASTM D2270, and by at least one of the following: a branch ratio of less than 0.19, a weight average molecular weight of between 300 and 45,000, a number average molecular weight of between 300 and 18,000, a molecular weight distribution of between 1 and 5, a pour point below −15° C., a bromine number of less than 3, a carbon number ranging from C30 to C1300, and a kinematic viscosity measured at 100° C. ranging from about 3 cSt to about 15,000 cSt, as measured by ASTM D445.

11. A method of improving shear stability comprising obtaining an oil formulation comprising a metallocene HVI-PAO with a viscosity greater than 125 cStkv 100° C. and a viscosity index greater than 195, a second base stock with a viscosity of at least 2 cStkv 100° C. and less than 60 cStkv 100° C. wherein the second base stock is at least 60 cStkv 100° C. less than the metallocene HVI-PAO, a di-octylsebacate ester with a viscosity of at least 2 and less than 6 cSt KV 100° C., the di-octylsebacate ester comprising more than 10 weight percent and less than 30 weight percent of the oil formulation and lubricating with the oil formulation, wherein the shear stability of the oil formulation as measured by % viscosity loss at 100° C. using the KRL Bearing Shear Test (CEC L-45-A-99) is less than or equal to 1.7%.

12. A method of blending an oil formulation with favorable shear stability comprising a) obtaining a metallocene HVI-PAO with a viscosity greater than 125 cStkv 100° C. and a viscosity index greater than 195, b) obtaining a second base stock with a viscosity of at least 2 cStkv 100° C. and less than 60 cStkv 100° C. wherein the second base stock is at least 60 cStkv 100° C. less than the metallocene HVI-PAO;

c) obtaining a di-octylsebacate ester with a viscosity of at least 2 and less than 6 cStkv 100° C., the ester comprising more than 10 weight percent and less than 30 weight percent of the oil formulation and c) blending the metallocene HVI-PAO with the second base stock and di-octylsebacate ester, wherein the shear stability of the oil formulation as measured by % viscosity loss at 100° C. using the KRL Bearing Shear Test (CEC L-45-A-99) is less than or equal to 1.7%.

13. The method of claim 12 wherein the oil formulation has a Noack volatility ASTM D5800 of 200° C. loss of 20 percent and less.

14. The method of claim 12 wherein the oil formulation has a Brookfield viscosity ASTM D2983-7, CP, of 40° C. of 13,180 and less.

* * * * *